US008272167B2

(12) United States Patent
Sato

(10) Patent No.: US 8,272,167 B2
(45) Date of Patent: Sep. 25, 2012

(54) SLIDING ASSISTANCE MECHANISM AND PULL-IN UNIT

(75) Inventor: Masakazu Sato, Yokohama (JP)

(73) Assignee: NIFCO Inc., Yokohama-Shi (JP)

( * ) Notice: Subject to any disclaimer, the term of this patent is extended or adjusted under 35 U.S.C. 154(b) by 515 days.

(21) Appl. No.: 12/312,431

(22) PCT Filed: Nov. 12, 2007

(86) PCT No.: PCT/JP2007/071946

§ 371 (c)(1),
(2), (4) Date: May 29, 2009

(87) PCT Pub. No.: WO2008/059804

PCT Pub. Date: May 22, 2008

(65) Prior Publication Data

US 2010/0037525 A1 Feb. 18, 2010

(30) Foreign Application Priority Data

Nov. 13, 2006 (JP) ..... 2006-306183
Mar. 23, 2007 (JP) ..... 2007-076620

(51) Int. Cl.
*E05D 15/06* (2006.01)

(52) U.S. Cl. ..... 49/404; 49/138; 49/367; 49/379; 49/360; 49/327

(58) Field of Classification Search ..... 49/404, 49/138, 213, 370, 367, 379, 360, 324, 327, 49/125, 61; 16/71, 72, 49; 312/139.2, 304, 312/333, 350

See application file for complete search history.

(56) References Cited

U.S. PATENT DOCUMENTS

| | | | | |
|---|---|---|---|---|
| 3,822,506 | A * | 7/1974 | Fishbach | 49/367 |
| 4,572,156 | A * | 2/1986 | Lentz | 126/548 |
| 4,949,505 | A * | 8/1990 | Cohrs | 49/367 |
| 5,148,631 | A * | 9/1992 | Bayard et al. | 49/449 |
| 5,755,060 | A * | 5/1998 | Zweili | 49/449 |
| 6,910,301 | B2 * | 6/2005 | Kalempa et al. | 49/368 |
| 2002/0053166 | A1 * | 5/2002 | Fries | 49/213 |
| 2005/0218759 | A1 * | 10/2005 | Kobayashi et al. | 312/331 |
| 2006/0016279 | A1 * | 1/2006 | Sato et al. | 74/89.17 |

FOREIGN PATENT DOCUMENTS

| | | |
|---|---|---|
| JP | 2005-023615 | 1/2005 |
| JP | 2005-034348 | 2/2005 |
| JP | 2006-045803 | 2/2006 |
| WO | WO 2006/025149 | 5/2006 |

* cited by examiner

*Primary Examiner* — Katherine W Mitchell
*Assistant Examiner* — Marcus Menezes
(74) *Attorney, Agent, or Firm* — Manabu Kanesaka

(57) ABSTRACT

A sliding assistance mechanism for helping a switching operation of a moving body on a main body side, includes a case attached to the main body side; first and second moving members slidably placed in the case, respectively; a pair of latches pivotally supported at each moving member, respectively, and releasably locked to corresponding parts of a case side; an urging device provided between both moving members; and a guide groove provided in the case for moving the latches along the same; and first and second operational members spaced apart from each other and provided in the moving body. When the moving members are at a halfway position, an engagement of one of the latches with the second operational member provided in the second moving member is released, and the moving body is pulled by the urging device to the second position.

14 Claims, 20 Drawing Sheets

(c)

SLIDING ASSISTANCE MECHANISM AND PULL-IN UNIT

FIELD OF THE INVENTION

The invention relates to a sliding assistance mechanism which helps switching operations for a moving body from a first position to a second position, and from the second position to the first position, and a pull-in unit which is used for the sliding assistance mechanism thereof.

BACKGROUND OF THE ART

FIGS. 20(*a*), 20(*b*) show a structure disclosed in a Patent Document 1, the reference numeral 21 represents a pull-in unit (sliding-door closer) attached to the upper side of a frame of an opening portion on a main body side, and the reference numeral 3 represents an operational member (engagement pin) provided on a sliding-door side which is the moving body. The pull-in unit 21 comprises a case 22, a hook member 36, urging means 35 and the like. The case 22 has a shape of a short container, and forms an engagement groove portion 25 extending in a longitudinal direction from one end side, and a sliding groove portion 31 (comprising a linear movement groove portion 32 and a rotational groove portion 33 which is folded back on one end side of the movement groove portion 32). The hook member 36 forms a retaining concave 46 disengaging the operational member 3 and engagement convexes 44, 45 which fit into the sliding groove portion 31. The urging means 35 urges the hook member 36 to the other end side of the sliding groove portion 31 in the state wherein one end of the urging means 35 is held in the hook member 36, and the other end of the urging means 35 is held in a case 22 side. The urging means 35 stores an urging force while a sliding door is slid from a closed direction to an open direction. The operational member 3 is attached to be swingable along a sliding hole 8 of a plate 5 and to be returnable due to an urging force (not shown) through an automatic return mechanism 4 relative to the upper end face of the sliding door.

In the above-mentioned structure, as shown in FIG. 20(*a*), the operational member 3 is moved toward the pull-in unit 21 on a main body side due to a closing operation of the sliding door. Then, the operational member 3 is fitted into the engagement groove portion 25, and after sliding along the engagement groove portion 25, as shown in FIG. 20(*b*), the operational member 3 is engaged with the retaining concave 46 of the hook member 36 and retained thereat. In this process, after the engagement convex 44 is rotated as a center of the engagement convex 45 while being guided by the rotational groove portion 33 of the sliding groove portion 31, and moved from a stand-by position to a pull-in position, the hook member 36 is fitted into the movement groove portion 32. Due to this engagement, the hook member 36 is slid toward the back end side of the case 22 by the urging force of an urging means 35 while holding the operational member 3, and completely pulled in. Also, from the above-mentioned state, due to an opening operation of the sliding door, the operational member 3 is slid to a front end side of the case 22 with the hook member 36, and stores an urging force to the urging means 35. Further, when the sliding door is opened, due to a returning operation of the operational member 3 through the automatic return mechanism 4, the engagement convexes 44 is moved to the rotational groove portion 33 from the movement groove portion 32, so that the hook member 36 is switched to the stand-by position in FIG. 20(*a*).

Incidentally, Patent Document 2 discloses a structure having a buffer member which creates a frictional force by being pushed by an operational member (stopper pin), as a braking mechanism which decreases speed of the sliding door, as well as the above-mentioned pull-in unit. This braking force is created separately from a rotary damper by a force wherein the operational member presses the buffer member inside the case, and increases in proportion to the increase of the speed of the sliding door.

Patent Document 1: Japanese Unexamined Patent Application Publication (TOKKAI) No. 2005-290769

Patent Document 2: Japanese Unexamined Patent Application Publication (TOKKAI) No. 2007-16521

DISCLOSURE OF THE INVENTION

Problems to be Solved by the Invention

In the above-mentioned conventional structure, when the sliding door is closed, in the middle of the closing operation, the sliding door is automatically switched to the closed position due to the urging force of the urging means 35, so that the problem of occurrence of an incomplete closed state of the sliding door can be reliably solved. However, when the conventional structure is applied to, for example, as shown in FIG. 21, right and left sliding doors A, B which are horizontally opened and closed, so called double sliding doors, and when each sliding door A, B is automatically pulled in the closed position from the middle position, and also pulled in the open position from the middle position, respectively, pull-in units 21A to 21D are required to be attached to at least 4 portions on a main body side. Accordingly, costs and assembly steps increase, thereby limiting the application thereof. Incidentally, in FIG. 21, the pull-in unit 21A is responsible for pull-in operation of the sliding door A during the closing operation; the pull-in unit 21B is responsible for pull-in operation of the sliding door B during the opening operation; the pull-in unit 21C is responsible for pull-in operation of the sliding door A during the opening operation; and the pull-in unit 21D is responsible for pull-in operation of the sliding door B during the closing operation.

Consequently, objects of the present invention are to enable the pull-in operations by a simple structure, for example, during both closing and opening operations, and also simplify the structure of each pull-in operation during the closing and opening operations of each sliding door of double sliding doors, so that the costs and assembly steps can be reduced, and applicability and functionality can be improved.

Means for Solving the Problems

The present invention of a first aspect is specified by structures common between a first embodiment and a second embodiment, and relates to a sliding assistance mechanism which helps operations of switching a moving body on a main body side from a first position to a second position, or from the second position to the first position. The sliding assistance mechanism comprises a case attached to the above-mentioned main body side; a first moving member and a second moving member which are respectively placed to be freely slidable to the above-mentioned case; a pair of latches pivotally supported at each moving member respectively, and releasably locked into corresponding parts of the case side; and urging means provided between both moving members for urging in a direction wherein the pair of latch supporting portions of each moving member moves closer to each other. When the moving members are halfway switched to the first position from the second position, or halfway switched to the second position from the first position, the engagement of one of the latches is released due to an operational member provided in the moving body. Also, the operational member is pulled into the first position or the second position with an approaching drive through the moving members and the urging means to the other side of the latches with the latch released from the engagement.

Incidentally, in the above-mentioned invention, the moving body includes a drawer and the like in addition to a sliding door. The main body includes a frame for the sliding door, a storage portion for the drawer and the like. The first position shows a completely closed position or open position of the moving body, and also includes the closed position wherein the moving body is completely pushed into the storage portion, or the open position wherein the moving body is completely pulled out. The second position shows the completely open position or closed position of the moving body, and also includes the open position wherein the moving body is completely pulled out of the storage portion, or the closed position wherein the moving body is completely pushed in. As long as the operational member functions such that one of the latches is released from the engagement and the operational member pulls (the moving body) is pulled with the latch released from the engagement into the first position or the second position with the approaching drive through the moving members and the urging means toward the other latch side, the structure of an engagement pin is not limited to each embodiment, but it can be the structure such as the Patent Document 1 or 2.

The second aspect of the present invention is specified by the structure of the first embodiment, and includes a pair of sliders wherein the first moving member and the second moving member are apart from each other. In this structure, when the moving body is halfway switched to the first position from the second position, or to the second position from the first position, one of the latches is released from the engagement due to the operational member provided in the moving body. Also, the operational member is pulled into the first position or the second position with the approaching drive through the slider and the urging means toward the other latch side with the latch released from the engagement.

The third aspect of the present invention is specified by the second embodiment, and the first moving member and the second moving member comprise a rack and a slider including a rotary gear engaging the rack. In this structure, when the moving body is halfway switched to the first position from the second position, or to the second position from the first position, one of the latches is released from the engagement due to the operational member provided in the moving body. Also, the operational member is pulled into the first position or the second position with the approaching drive through the rack or the slider, and the urging means toward the other latch side with the latch released from the engagement.

The present invention is preferably specified as follows.

(1) The pull-in unit has a structure including braking means for braking the sliding (i.e., a sliding speed of the moving body through the moving member) of each moving member (fourth aspect) In this case, the braking means preferably has a structure including a piston-type damper or rotary damper (fifth aspect); however, it may be the braking means shown in the Patent Document 2 or a similar structure thereof. Further, in the case of the third aspect, the rotary gear has a structure of the rotary damper (sixth aspect).

(2) The pull-in unit has a structure including two sets of the first moving member and the second moving member; the urging means; the pair of latches in the case (seventh aspect).

(3) The moving body is the sliding door, and the first position is the closed position of the sliding door, and the second position is the fully open position of the sliding door (eighth aspect).

(4) The moving bodies are double sliding doors, and the pull-in unit is attached in approximately the middle of the upper side of the frame or/and the lower side of the frame of the main body wherein the double sliding doors are placed (ninth aspect).

Also, in a tenth aspect of the present invention, the pull-in unit according to any one of the first to seventh aspects is specified only by main components structuring the sliding assistance mechanism, and used for the sliding assistance mechanism which helps the moving body to be switched from the first position to the second position or from the second position to the first position on the main body side.

EFFECTS OF THE INVENTION

In the invention of the first aspect, the pull-in unit comprises a case, two moving members and latches, and the single urging means. While the operational members on a moving body side is on the way to switch the moving body from the closed direction to the open direction, and from the open direction to the closed direction, i.e., the moving body is automatically pulled in halfway respectively due to the urging force of the urging means and switched to the closed position or the open position. Accordingly, the cost and assembly step for attachment of this invention can be reduced due to a simpler structure than a conventional structure, so that applicability and functionality can be improved.

In addition to the effect of the first aspect, the invention of the second aspect can be structured by a pair of sliders, i.e., by members with the same shape or a similar shape wherein the first moving member and the second moving member are slid in the same manner. Accordingly, for example, a shape of each slider and the sliding guide structure relative to the case can also be simplified.

In addition to the effect of the first aspect, the invention of the third aspect is structured by the sliders wherein the first moving member and the second moving member include the rack and the rotary gear engaging the rack. Accordingly, the invention can obtain an excellent sliding characteristic through so-called rack and pinion mechanism, and it also can be expanded into a sixth aspect.

In the invention of the fourth aspect, the moving body is automatically pulled into the final closed position or open position from the middle of each closed or open position due to the urging force of the urging means. However, the moving body is slid to the closed position or the open position at a slow speed through the braking means, so that a high-quality feeling can be provided, and also the problem of the contact noise can be eliminated.

In the invention of the fifth aspect, for a structure with additional braking means, for example, as shown in the first embodiment, the structure of the invention can be simplified by using the piston-type damper; or as shown in the second embodiment, an excellent operation can be obtained through the rotary gear by using the rotary damper. Namely, the invention has the special significance of being able to select according to a usage, required characteristic, or the like. Also, in the invention of the sixth aspect, since the rotary gear of the third aspect constitutes the rotary damper, an excellent sliding characteristic can be also provided due to the rack and pinion mechanism with a braking force of the rotary damper.

In the invention of the seventh and ninth aspects, for example, each sliding door of double sliding doors is automatically pulled in by the single pull-in unit and multiple operational members due to the urging force of the urging means, and switched respectively from the middle of the closing position or the opening position to the closed position or the open position. As a result, the cost can be reduced compared to a conventional structure, and an excellent switching characteristic of each sliding door can be obtained.

In the invention of the eighth aspect, the moving body is the sliding door, and while the sliding door is halfway switched from the closed direction to the open direction, and from the open direction to the closed direction, the sliding door is pulled into the final closed position or the open position due to the urging force of the urging means. Accordingly, operability of the sliding door can be improved.

In the invention of the tenth aspect, for example, by providing each pull-in unit which is a main component of the above-mentioned sliding assistance mechanism with the operational members as a pair, a user can select a type according to the usage and can easily use it.

BRIEF DESCRIPTION OF THE DRAWINGS

FIG. 1(*b*) is a side view; FIG. 1(*c*) is a top view; and FIG. 1(*d*) is a right end view, of a pull-in unit of the first embodiment.

FIG. 4(*b*) is a pattern diagram showing a fully-opened state of an opening portion in which the double sliding doors are switched to the open position; and FIG. 4(*c*) is a pattern diagram showing a fully-closed state of the opening portion in which the double sliding doors are switched to the closed position.

FIG. 7(*c*) is a sectional view taken along line C-C in FIG. 7(*a*).

FIG. 8(*c*) is a sectional view taken along line D-D in FIG. 8(*a*).

FIG. 9(*b*), FIG. 9(*c*) are external views showing two sliders of the pull-in unit.

FIG. 17(*b*), FIG. 17(*c*) are schematic external views showing a rack and the slider of the pull-in unit.

FIG. 18(*b*) is a top view; and FIG. 18(*c*) is a side view.

FIG. 19(*b*) is a top view; FIG. 19(*c*) is a side view; FIG. 19(*d*) is a sectional view taken along line F-F in FIG. 19(*b*); and FIG. 19(*e*) is a sectional view taken along line G-G in FIG. 19(*c*).

BEST MODE FOR CARRYING OUT THE INVENTION

Figure 19A:
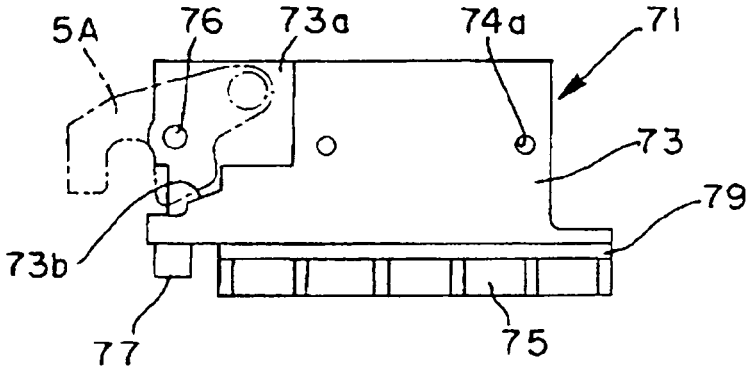
FIG. 19(*a*), FIG. 19(*b*), FIG. 19(*c*), FIG. 19(*d*), FIG. 19(*e*) show details of the slider, wherein FIG. 19(*a*) is a bottom view.
Figure 19B:
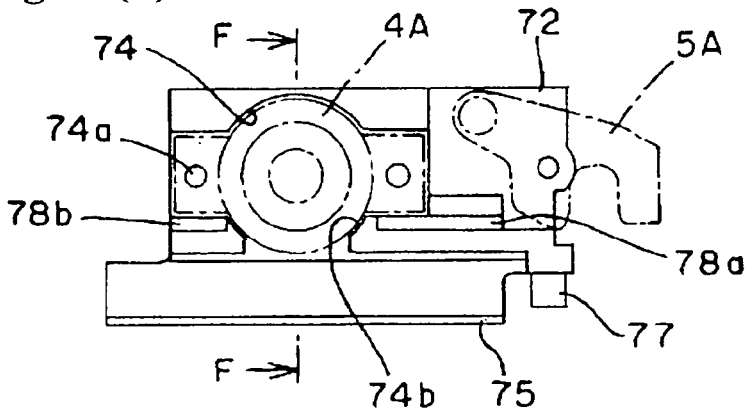
Figure 19C:
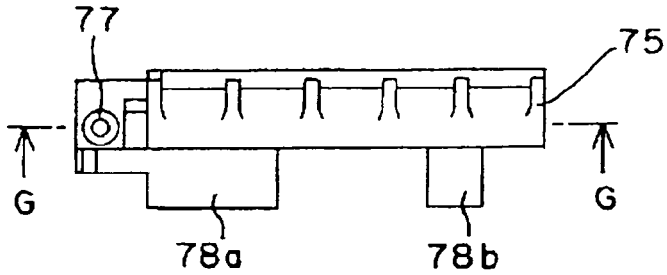
Figure 19D:
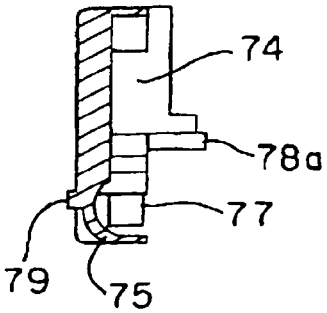
Figure 19:
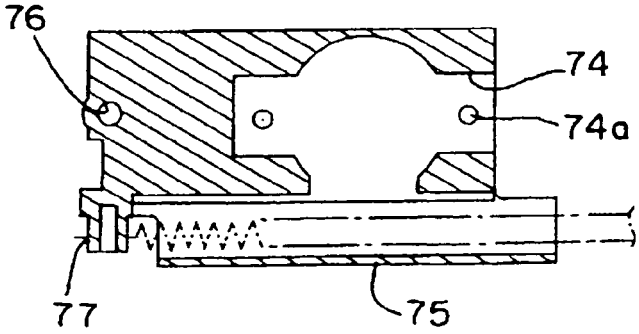
Figure 20:
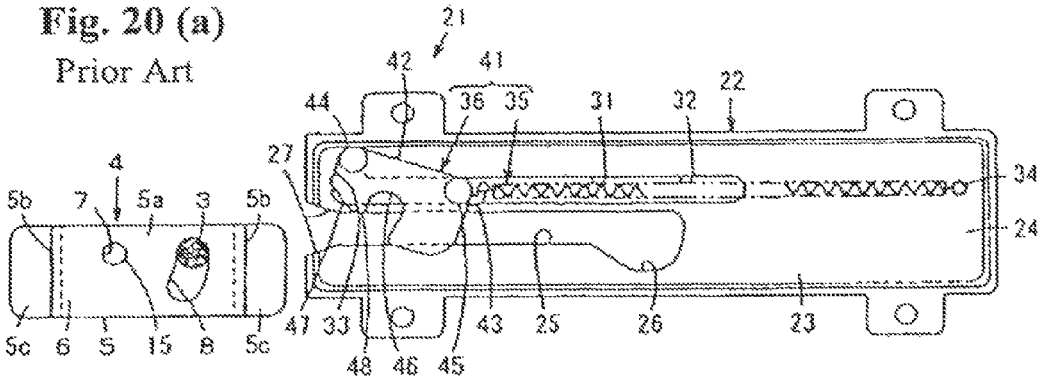
Fig. 20 (a) Prior Art
FIG. 20(*a*), FIG. 20(*b*) are explanatory drawings showing essential parts of a mechanism of the Patent Document 1.
Figure 20:
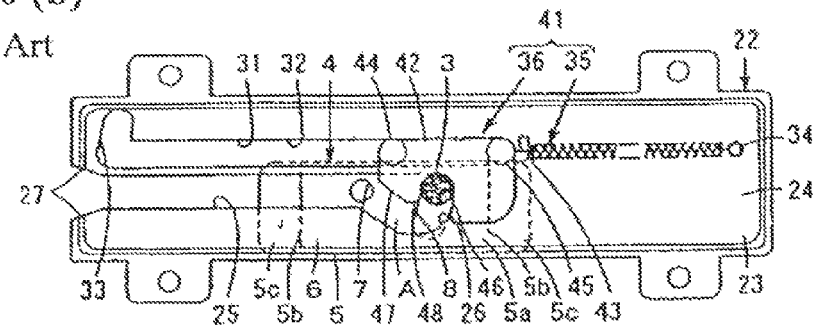
Fig. 20 (b) Prior Art
Figure 21:
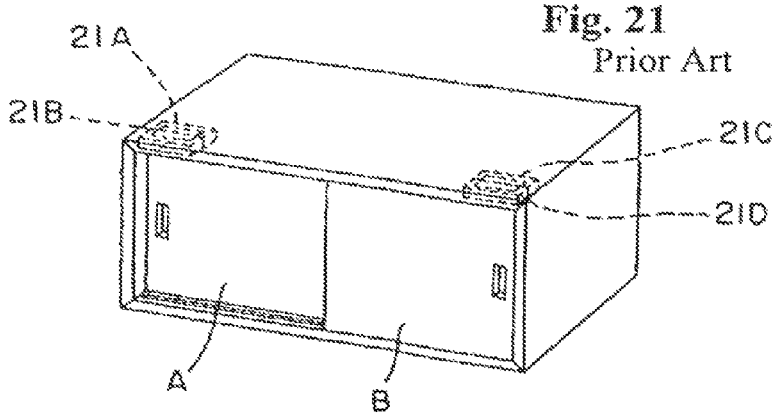
Fig. 21 Prior Art
FIG. 21 is an explanatory drawing when the mechanism of the Patent Document 1 is applied to the double sliding doors.

The first embodiment and the second embodiment of the present invention will be explained with reference to drawings. FIG. 1(*a*) to FIG. 10(*b*) show the first embodiment, and FIG. 11(*a*) to FIG. 19(*e*) show a second embodiment. Incidentally, a part of each drawing is omitted or simplified for the sake of preparing drawing figures. In order to make operations clearly understandable in FIGS. 5(*a*), (*b*), and FIGS. 6(*a*), (*b*), a piston-type damper which is braking means, is omitted. In the explanation hereinafter, mechanical characteristics, a pull-in unit of the first embodiment and assembly and operation thereof, and the pull-in unit of a second embodiment and the assembly and operation thereof, will be described in detail in the above-mentioned order.

Figure 10A:
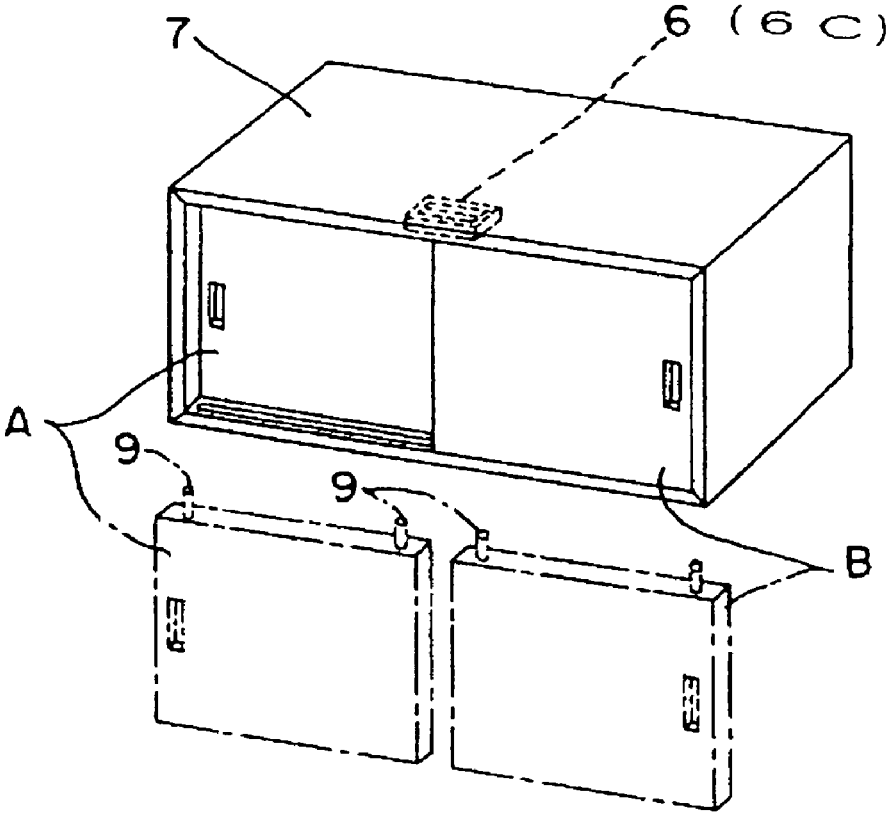
FIG. 10(*a*), FIG. 10(*b*) are pattern diagrams showing two examples of the application of the pull-in unit.
Figure 10B:
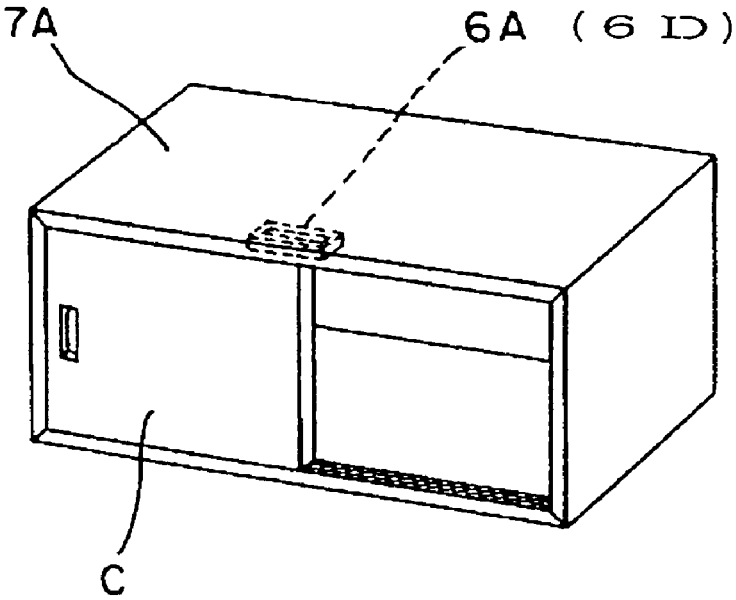
Figure 11A:
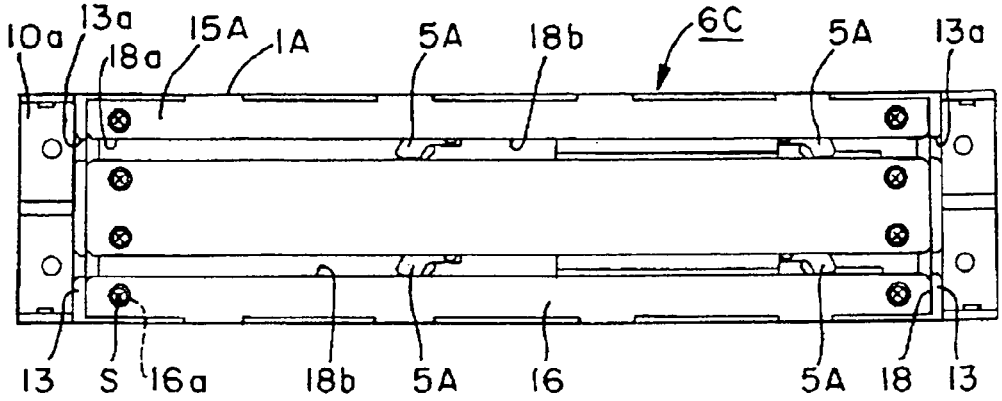
FIG. 11(*a*) is a bottom view, FIG. 11(*b*) is a side view, FIG. 11(*c*) is a top view, and FIG. 11(*d*) is a right end view, of the pull-in unit of a second embodiment.
Figure 11B:
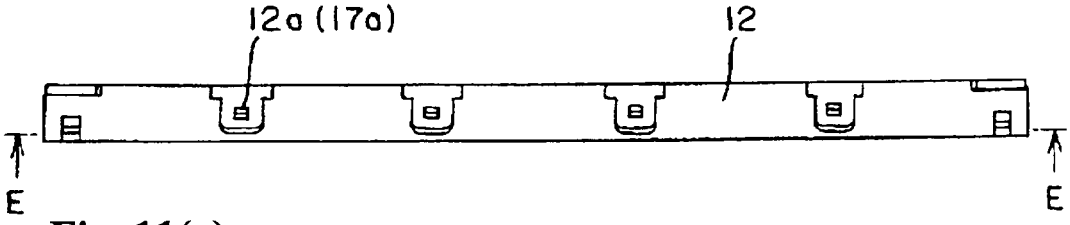
Figure 11C:
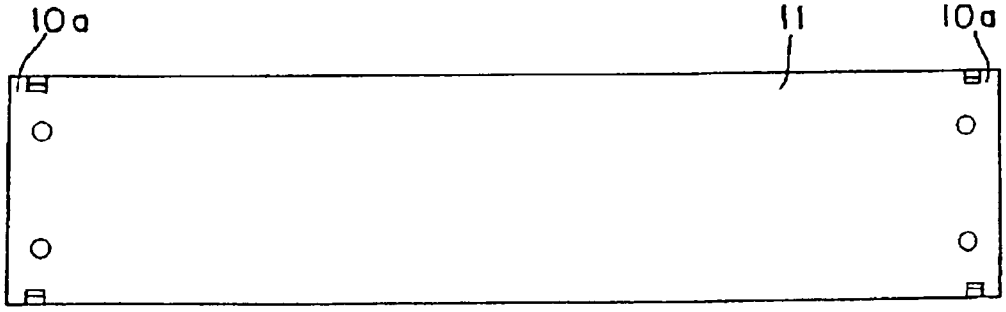
Figure 11D:
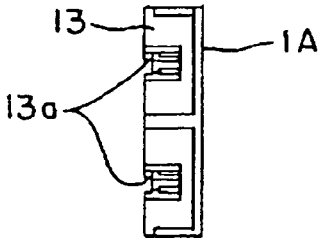

(Mechanical Characteristics) A sliding assistance mechanism of the present invention comprises, as illustrated in FIGS. 10(*a*), 10(*b*), a pull-in unit 6 or 6A of the first embodiment, or a pull-in unit 6C or 6D of the second embodiment, which is attached to a main body 7; and multiple engagement pins 9 as operational members which are provided in sliding doors A to C as moving bodies. Here, the main body 7 is, for example, a kitchen, shelf or the like which has an opening portion, or a desk, copier or the like which has a storage space. The moving bodies are not limited to the sliding doors A, B, or C, but may be a drawer body for storage or the like placed to be slidable between a closed position (corresponding to a pushed-in position in the case of the drawer body) and an open position (corresponding to a pulled-out position in the case of the drawer body) along a guide rail provided in the opening portion of the main body 7 or the storage space. Also, as illustrated in FIGS. 10(*a*), 10(*b*), the pull-in unit 6 or 6A of the first embodiment, or the pull-in unit 6C or 6D of the second embodiment is divided roughly into the following two categories according to a type of the moving bodies which become a target for the pull-in unit.

The first structure is the pull-in unit 6 or 6C shown in the first embodiment or the second embodiment. The pull-in unit 6 or 6C is used in the case that each sliding door A, B forming double sliding doors as the moving bodies as shown in FIG. 10(*a*) is respectively pulled in. When the pull-in unit 6 or 6C is specified with a common structure of the first embodiment and the second embodiment, as a unit, the pull-in unit 6 or 6C includes a case 1 or 1A attached to the main body 7; the first moving member and a second moving member (in the first embodiment, a pair of sliders 2A, 2B; and in the second embodiment, racks 60 and a slider 71 including a rotary gear 45 engaging the rack) which are respectively placed to be freely slidable to the above-mentioned case; a pair of latches 5 or 5A pivotally supported at each moving member respectively, and releasably locked to corresponding parts of the case 1; and urging means 3 or 3A provided between both moving members and urging in a direction wherein the pair of latch supporting portions of each moving member move closer to each other. The pull-in unit 6 or 6C is placed relative to the case 1 or 1A. In the case that the pull-in unit 6 or 6C is used, two engagement pins 9 are protrudingly provided to the sliding doors A and B, respectively.

The second structure is the pull-in unit 6A or 6D as shown in FIG. 10(*b*) which is used in the case that a single sliding door C is slid relative to the opening portion of a main body 7A as the moving body. Although it is not shown in the figures, each pull-in unit 6A or 6D is provided with the first moving member and the second moving member (in the first embodiment, the pair of sliders 2A, 2B; and in the second embodiment, the racks 60 and the slider 71 including the rotary gear 45 engaging the rack) which are respectively placed to be slidable; the pair of latches 5 or 5A pivotally supported at each moving member respectively, and releasably locked to the corresponding parts of the case 1; and the urging means 3 or 3A provided between both moving members and urging in the direction wherein the pair of latch supporting portions of each moving member moves closer to each other. The pull-in unit 6A or 6D with the above-mentioned structure is placed relative to the case (in this structure, with approximately half the size of the case 1 or 1A). Specifically, the pull-in unit 6A or 6D has the structure wherein one side of the sliders 2A, 2B; the urging means 3 and braking means 4; and the latches 5, 5 are omitted from FIGS. 2, 3; or wherein one side of the racks 60 and the slider 71; the urging means 3A and braking means 4A; and the latches 5, 5 are omitted from FIG. 12. The above-mentioned structures can be easily understood from the following pull-in unit 6 or 6C, so that explanations thereof are omitted. Also, in the case that this pull-in unit 6A or 6D is used, two engagement pins 9 are provided relative to the sliding door C which is the moving body in a protruding condition.

Figure 1A:
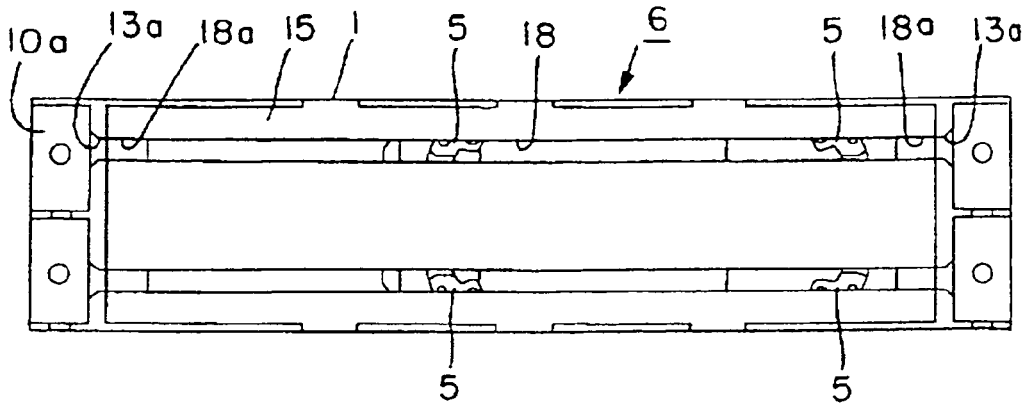
FIG. 1(*a*) is a bottom view.
Figure 1B:
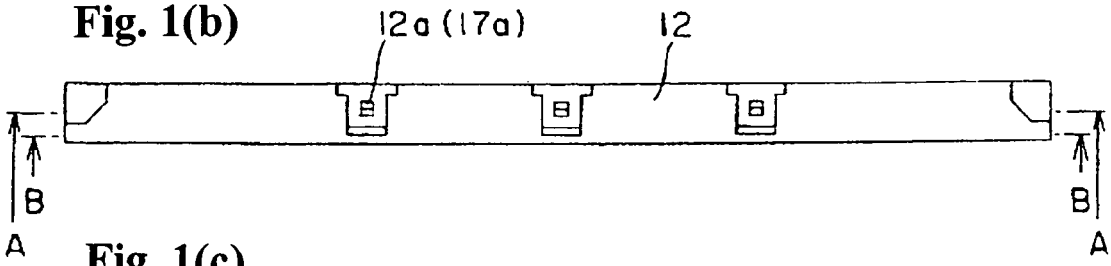
Figure 1C:
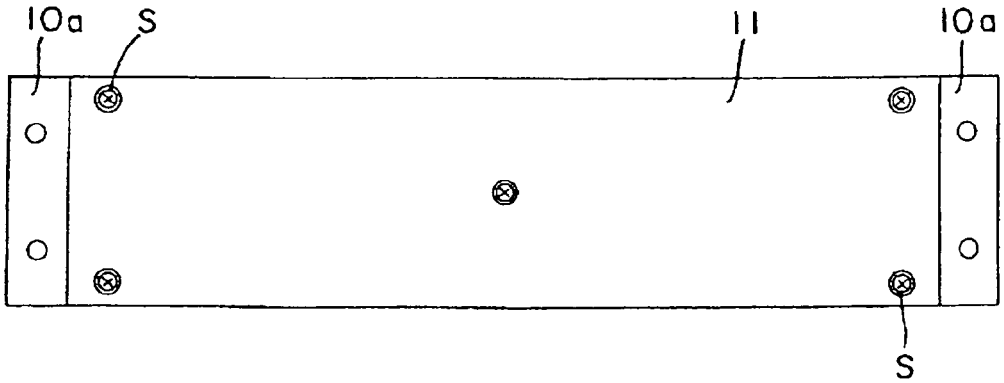
Figure 1D:
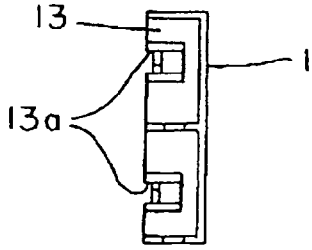
Figure 2:
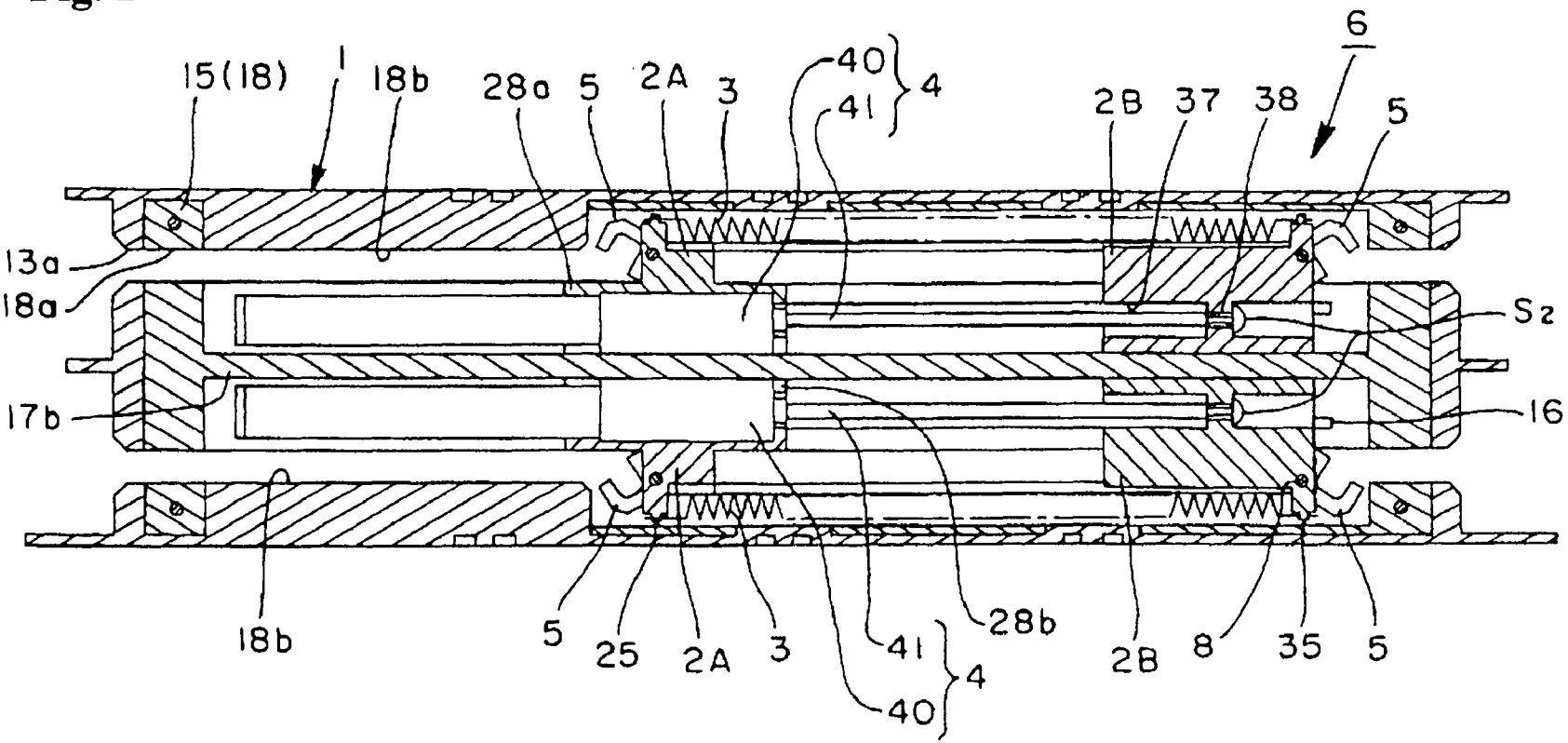
FIG. 2 is an enlarged sectional view taken along line A-A in FIG. 1(*b*).
Figure 3:
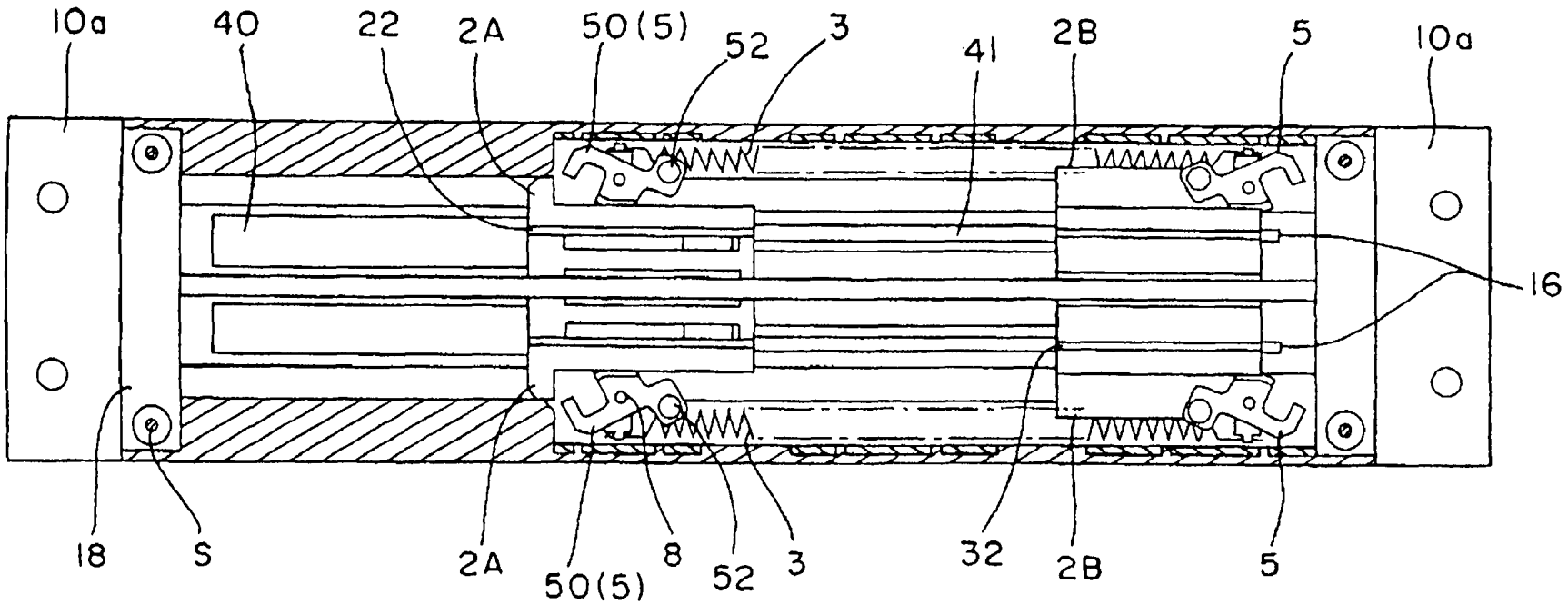
FIG. 3 is an enlarged sectional view taken along line B-B in FIG. 1(*b*).
Figure 4A:
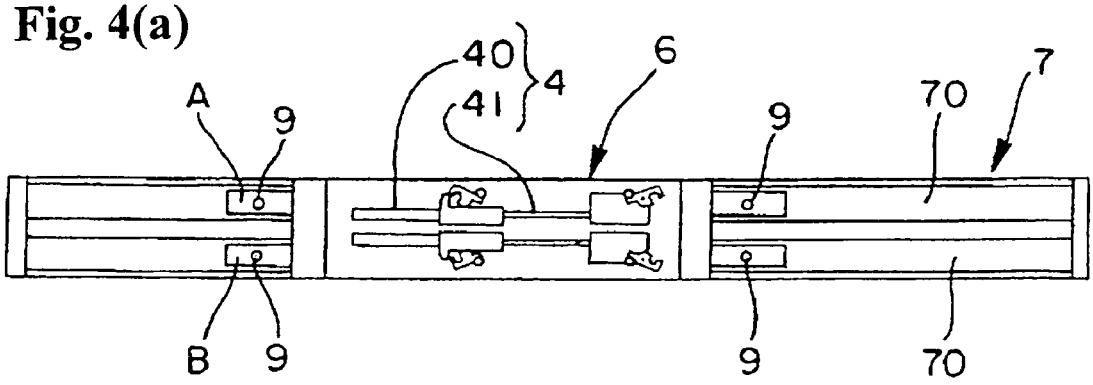
FIG. 4(*a*) is a pattern diagram showing a relationship between the pull-in unit and a frame on a main body side wherein double sliding doors are placed.
Figure 4B:
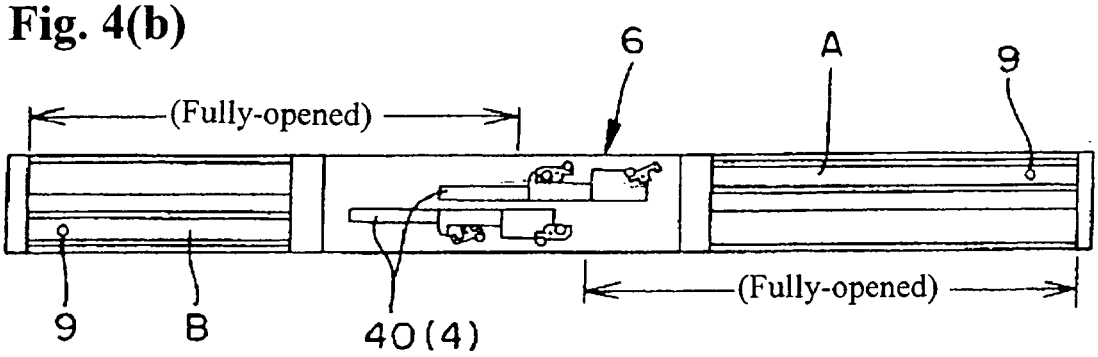
Figure 4C:
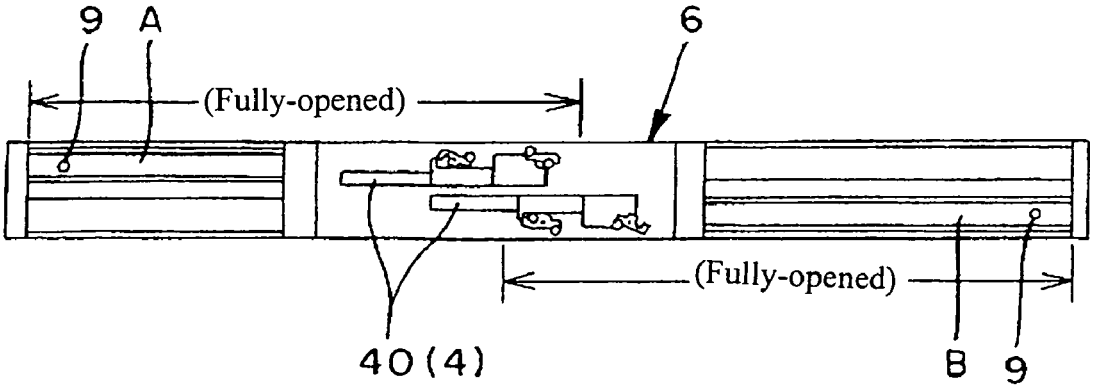
Figure 5A:
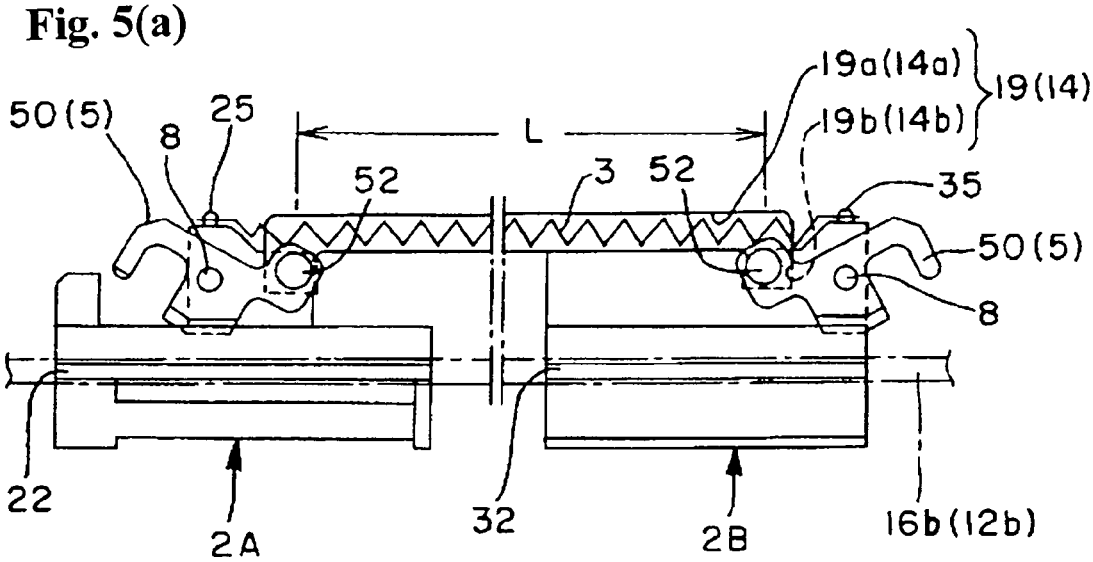
FIG. 5(*a*), FIG. 5(*b*) are pattern diagrams showing essential parts of the pull-in unit in a state of FIG. 4(*a*).
Figure 5B:
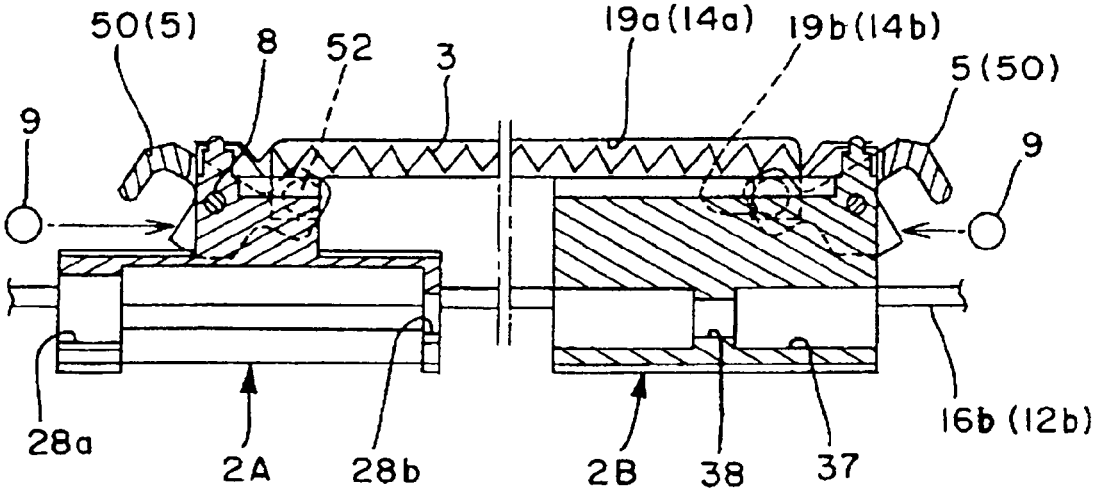
Figure 7A:
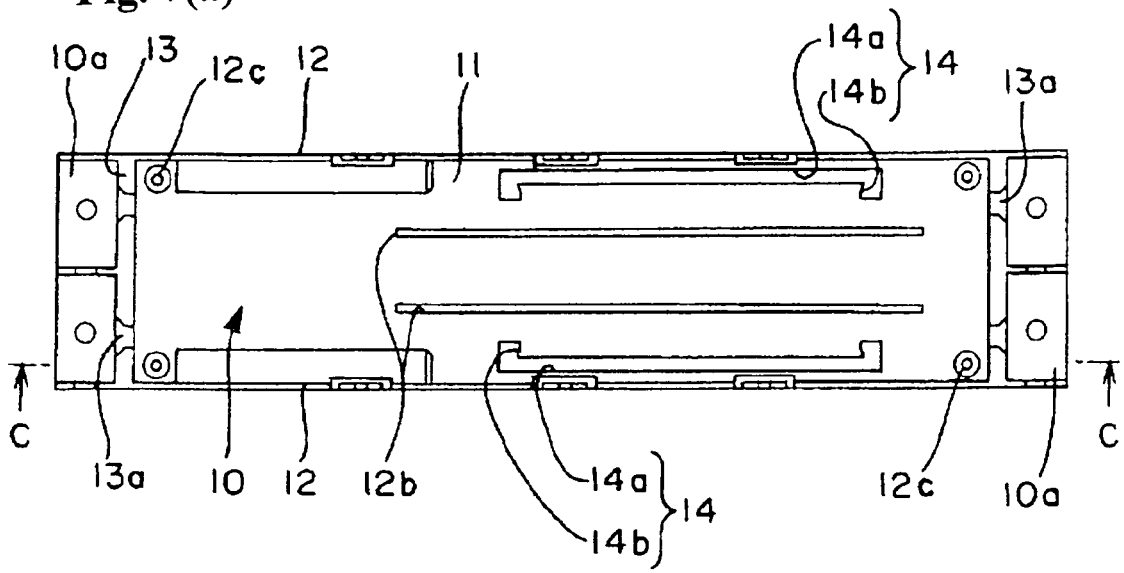
FIG. 7(*a*) is a bottom view and FIG. 7(*b*) is a side view showing a case of the pull-in unit.
Figure 7B:
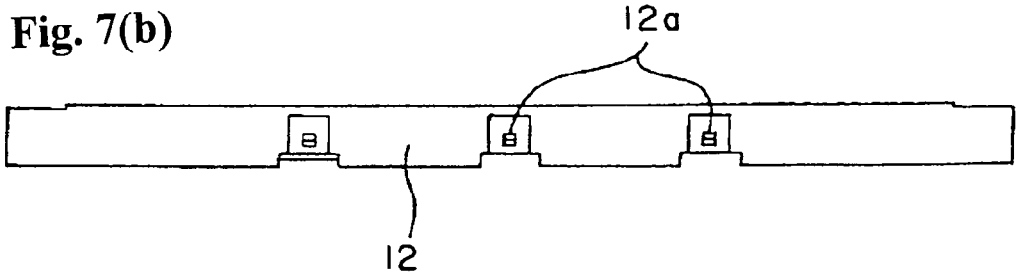
Figure 7C:
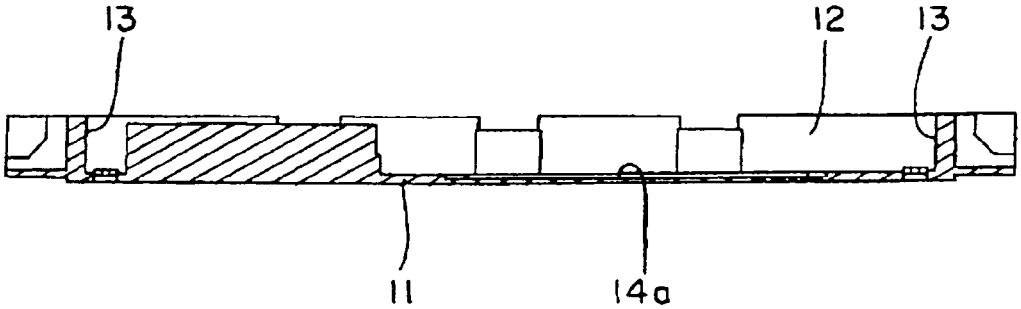
Figure 8A:
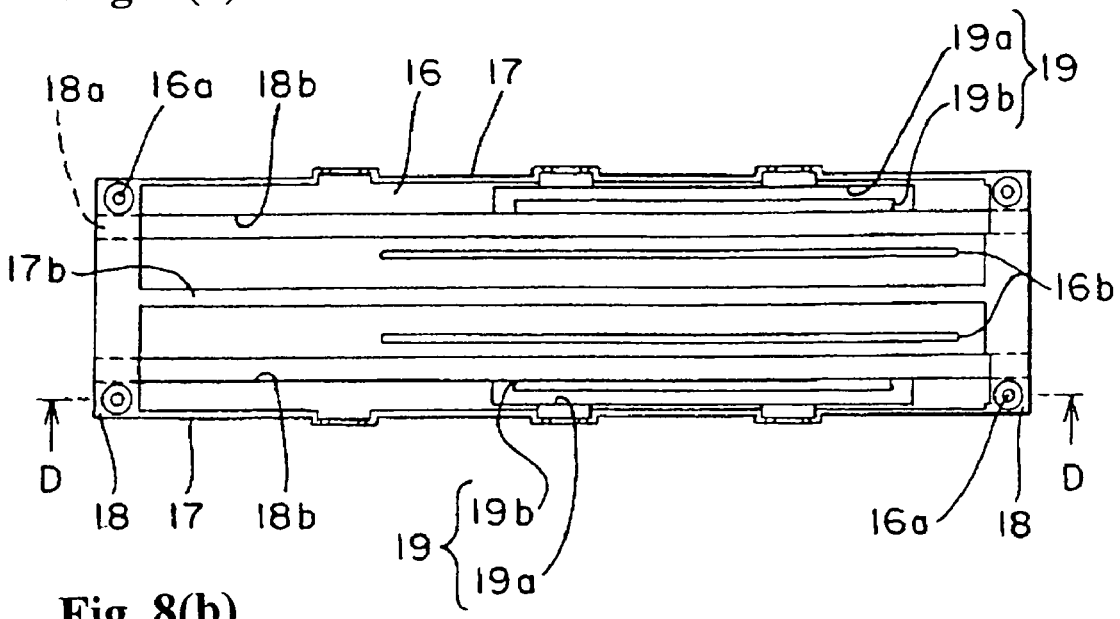
FIG. 8(*a*) is a top view and FIG. 8(*b*) is a side view showing a cover of the case.
Figure 8B:
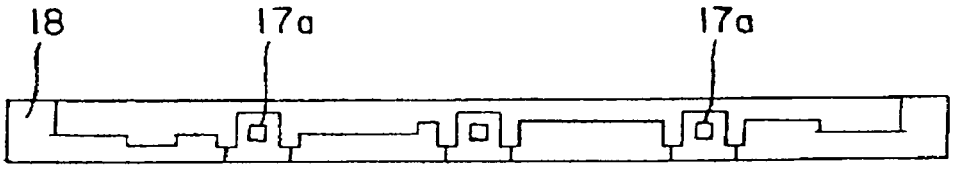
Figure 8C:
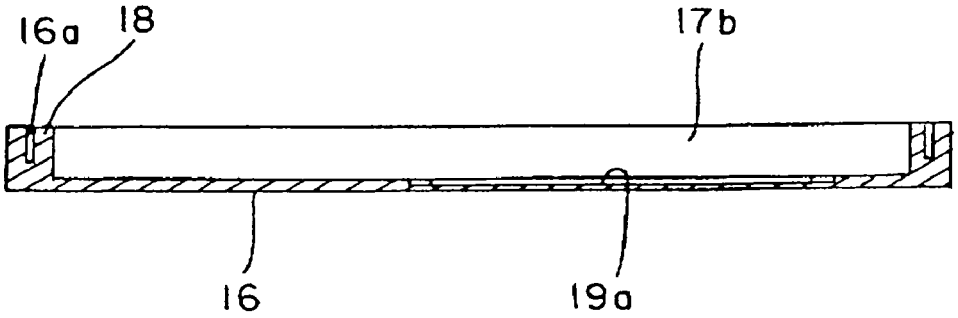

(Pull-in unit of the first embodiment) FIGS. 1(*a*) to 1(*d*) show the pull-in unit; FIGS. 2, 3 show internal structure of the pull-in unit; FIGS. 4(*a*) to 4(*c*), 10(*a*), 10(*b*) show examples; FIGS. 5(*a*), 5(*b*), 6(*a*), 6(*b*) show operations of essential parts; and FIGS. 7(*a*) to FIG. 9(*c*) show structural members of the pull-in unit. The pull-in unit 6 in the first embodiment comprises the pair of sliders 2A, 2B placed in the case 1 for sliding in a direction of being spaced apart from each other; the urging means 3 urging the pair of sliders 2A, 2B to come close to each other; and the pair of latches 5, 5 pivotally supported at each slider 2A, 2B respectively, and releasably locked to the corresponding parts of the case 1 so that the pair of sliders can be held in a separated state from each other.

In the above-mentioned portions, as shown in FIGS. 1(*a*) to 1(*d*), 7(*a*) to 7(*c*), 8(*a*) to 8(*c*), the case 1 integrally forms space portions 10 which open the lower side; and attachment portions 10*a* for the main body which project to right and left of the space portions 10. The case 1 also includes a cover 15 attached to close the space portions 10. The space portions 10 have the shape of an elongated short container, and divided into an upper face 11, both side faces 12, and end faces 13. The cover 15 has the form of a flat container with a size which can be roughly stored in the space portions 10. The inside of the cover 15 is divided into a lower face 16, both side faces 17, right and left end faces 18, and a dividing portion 17*b* which divides the inside of the cover 15 into two. Incidentally, in the embodiment of the present invention, the case 1 has the space portion opening the lower side; however, the unit of the present invention can be placed in the bottom face portion or side portion. In this case, the space portion is not open on the lower side, and will be the space portion whose upper side is open, or side portions are open.

On both side faces 12 and both side faces 17, multiple pairs of projecting locking portions 12*a* and bore-like engagement portions 17*a* are provided and engage with each other when the cover 15 is placed on the space portions 10. On each end face 13 and each end face 18, openings 13*a*, 18*a* with a concave or reverse-concave shape are bilaterally provided in 2 places on each side, and inside and outside of the openings 13*a*, 18*a* are respectively communicated to each other so that the engagement pins 9 can penetrate, when the cover 15 is placed on the space portions 10. Also, on the lower face 16 of the cover, guiding bores 18*b* are formed in such a way as to communicate with the respective right and left openings 18*a*, 18*a*. Thus, the engagement pins 9 can be entered in and out of the case 1 along the guiding bores 18*b* through the openings 13*a* of the end faces 13 and the openings 18*a* of the end faces 18 relative to the case 1.

Also, on the upper face 11 and the lower face 16, attachment bores 12*c*, 16*a*; two respective guide grooves 12*b*, 16*b* for the sliders; and two respective guide grooves 14, 19 for the latches are provided so as to roughly face each other. As for the above-mentioned portions, screws S are screwed into the attachment bores 12*c*, 16*a* when the cover 15 is attached to the space portions 10. The respective guide grooves 12*b*, 16*b* have respective pairs of linear grooves, and guide the sliders 2A, 2B to slide in a state wherein the guide grooves 12*b*, 16*b* are fitted into projections 22 or 32 provided on upper and lower faces of the sliders 2A, 2B. The respective guide grooves 14, 19 include a pair of linear grooves 14*a*, 19*a* which are respectively parallel to the guide grooves 12*b*, 16*b*, and locking grooves 14*b*, 19*b* with a roughly L shape provided on both sides of the linear grooves 14*a*, 19*a*. The respective guide grooves 14, 19 include convexes 52 wherein the latches 5 are provided on the upper and lower faces described hereinafter, and guide the latches 5 to slide along the linear grooves 14*a*, 19*a* in a state of fitting into the convexes 52. Also, the convexes 52 lock the sliding of the latches 5 (and the sliders) by engaging the locking grooves 14*b*, 19*b*. Incidentally, each locking groove 14*b*, 19*b* is formed with the groove width at the end thereof formed slightly larger than the groove width of the rising base portion so that the locking groove 14*b*, 19*b* does not unexpectedly release the engagement when the convexes 52 of the latches 5 are engaged.

Figure 9A:
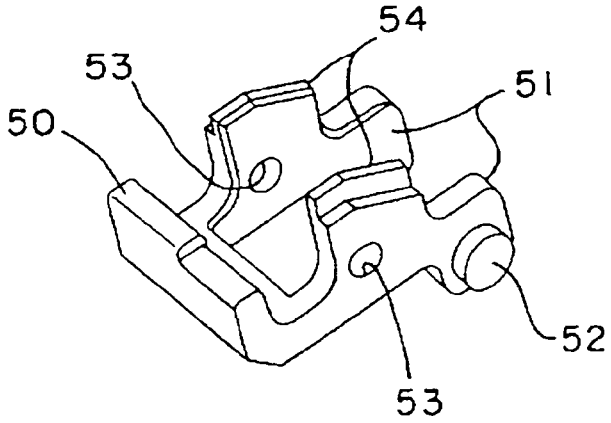
FIG. 9(*a*) is an external view showing a latch of the pull-in unit.
Figure 9B:
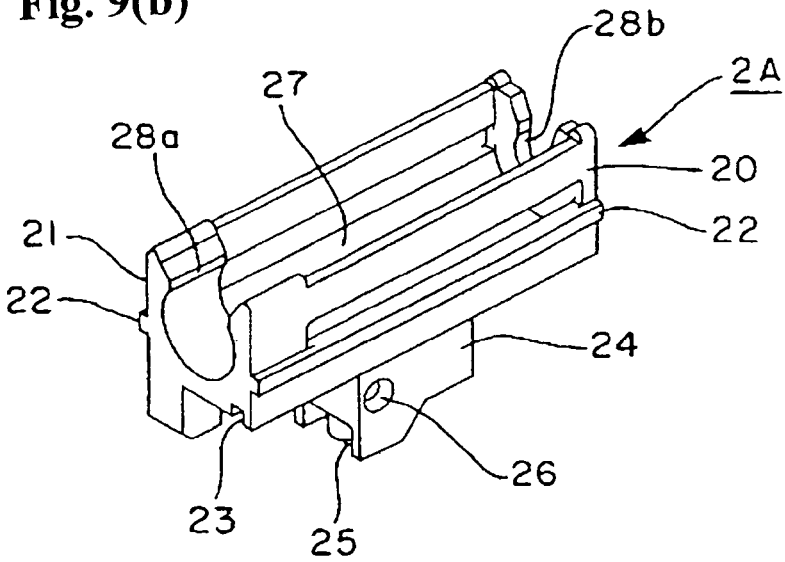
Figure 9C:
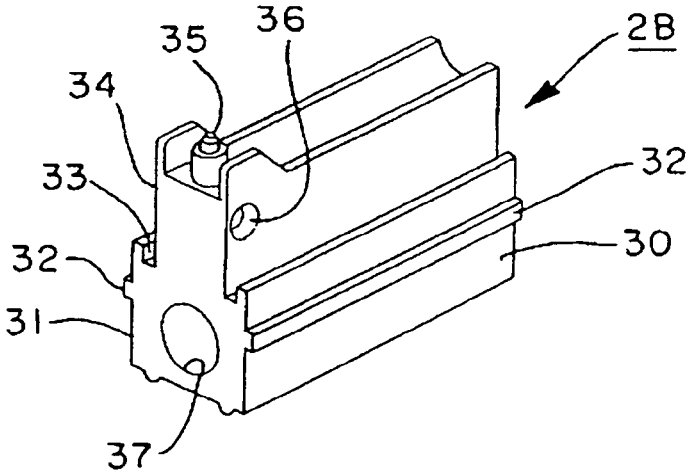

As shown in FIGS. 2, 3, 9(*a*) to 9(*c*), the sliders 2A, 2B have the following in common. Both have a block shape placed in a space between the upper face 12 of the case side and the lower face 16 of the cover side; form the projections 22 or 32 on upper and lower faces 20, 21 or upper and lower faces 30, 31; include grooves 23 or 33 for controlling the movement of the latches 5; form locking axis 25 or 35 for locking a corresponding end portion of a coil spring which is the urging means 3 on the side face of the block shape; and form an axial bore 26 or 36 for pivotally supporting the latches 5 to be rotatable through shafts 8. Here, each projection 22, 32 linearly extends toward the other end side from one end of the upper and lower faces, and fits into the guide grooves 12*b*, 16*b*. Each groove 23, 33 is located on the side wherein the axial bore 26 or 36 is provided, and linearly extends toward the other end side from one end. The locking axes 25, 35 and the axial bores 26, 36 include a supporting portion 24 or 34 projecting one-step on one side of the block shape. The locking axes 25, 35 are projected on the end face of the supporting portion 24 or 34, and the axial bores 26, 36 penetrate the supporting portion 24 or 34 in an up and down direction.

Also, the slider 2A includes a holding portion 27 having a roughly U-shape in a cross sectional view and provided along one side of the opposite side of the supporting portion 24; a U-shaped clamp portion 28*a* having a smaller diameter than that of the holding portion 27 and located on one end of the holding portion 27; and a U-shaped clamp portion 28*b* having a smaller diameter than that of the clamp portion 28*a* and located on the other end of the holding portion 27. On the other hand, the slider 2B includes a holding bore 37 penetrating along one side of the opposite side to the supporting portion 34; and an attachment bore 38 (refer to FIG. 2) wherein a part of the diameter of the holding bore 37 is reduced.

Incidentally, the sliding of the sliders 2A, 2B is braked by the braking means 4 when the other side is slid in a state wherein one side is locked, and adversely, when one side is slid in a state wherein the other side is locked. In this embodiment, the piston-type damper is used for the braking means 4, so that both sliders 2A, 2B have different shapes; however, in the case that a rotary damper is used for the braking means, the sliders can be formed in the same shape or similar shape.

Figure 6A:
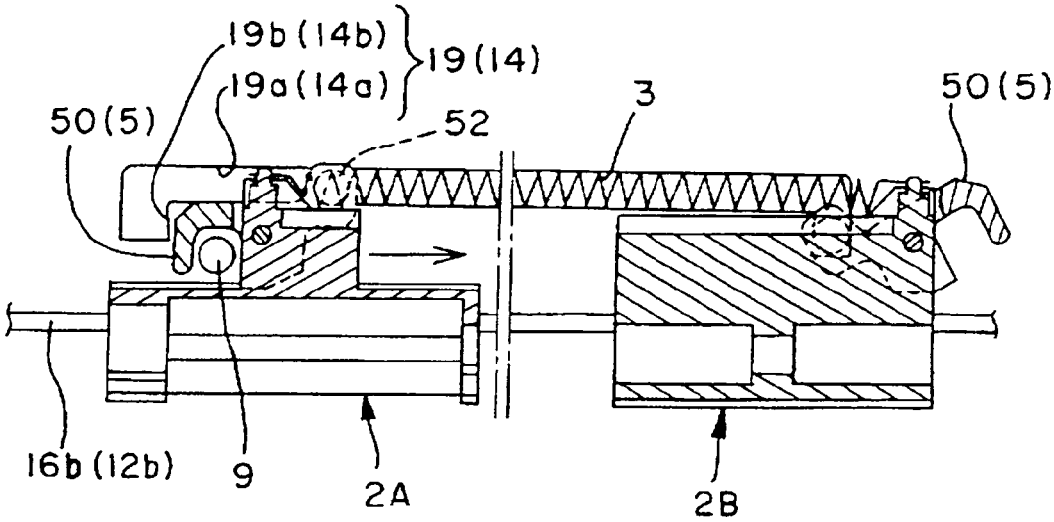
FIG. 6(*a*), FIG. 6(*b*) are pattern diagrams showing the essential parts of the pull-in unit in a state of FIGS. 4(*b*) and FIG. 4(*c*).
Figure 6B:
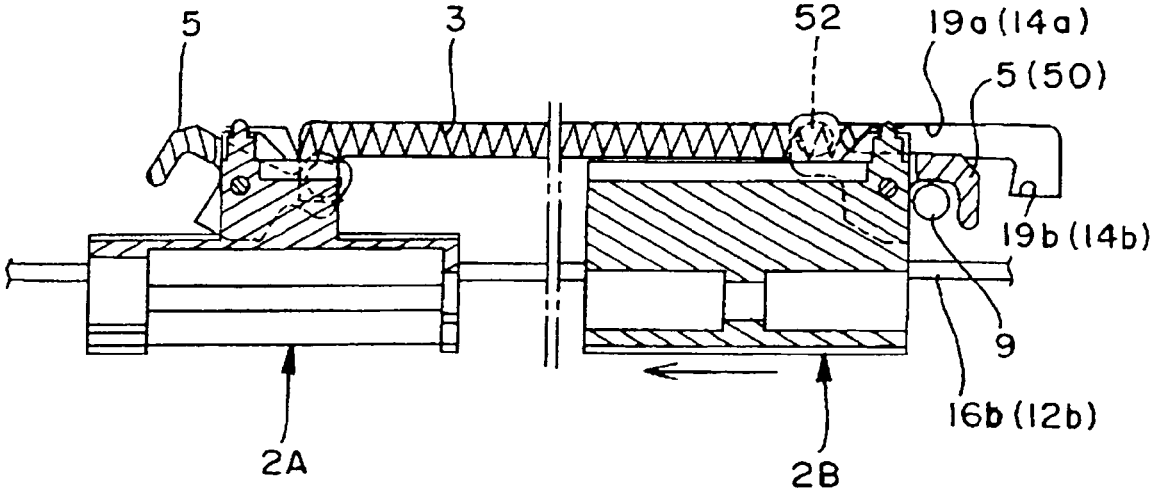

Also, in the above-mentioned sliders 2A, 2B, the latches 5 are attached to be respectively rotatable around the shafts 8 which are inserted into the axial bores 26, 36 of the supporting portions 24, 34. As shown in FIGS. 9(*a*) to 9(*c*), the latches 5 integrally includes hook portions 50; a pair of arm portions 51 projecting from both sides of the base portion of the hook portions 50; axial bores 53 respectively provided on a coaxial line in roughly the middle part of each arm portion 51; the convexes 52 respectively projecting from the outer surface of the end of each arm portion 51; and supporting portions 54 provided near the axial bore 53 of each arm portion 51 and projecting to the same direction as that of the hook portions 50. As for the above-mentioned portions, as shown in FIGS. 6(*a*), 6(*b*), the hook portions 50 have a shape to be able to hold the engagement pins 9 in a state where the latches 5 are rotated around the shafts 8 as a fulcrum. Each arm portion 51 maintains a distance corresponding to the board thickness of the supporting portions 24 or 34.

(Assembly) In the above-mentioned each member, for example, after each latch 5 is pivotally supported at the sliders 2A, 2B, both sliders 2A, 2B are attached to the piston-type damper which is the braking means. By manufacturing two pairs of the above; building them onto the case 1 with the urging means 3; and attaching the cover 15 to the case 1, the pull-in unit 6 is completed.

First, each latch 5 is assembled to be respectively rotatable through the shafts 8 which are inserted into the axial bores 26, 36 of the supporting portions 24, 34 relative to the sliders 2A, 2B. Specifically, in each latch 5, after the supporting portion 24 of the slider 2A, or the supporting portion 34 of the slider 2B are placed between both arm portions 51, and the axial bore 53 and the axial bore 26, or the axial bore 53 and the axial bore 36 are adjusted to correspond to each other, the shafts 8 are inserted into each axial bore. Accordingly, the latch 5 is pivotally supported to be rotatable relative to the slider 2A or 2B. Incidentally, both ends of the shafts 8 are appropriately retained.

Next, the slider 2A and the slider 2B are connected through the piston-type damper which is the braking means 4. As for this piston-type damper, a conventional product (for example, Japanese Unexamined Patent Application Publication (TOKKAI) No. 2006-29564 and so on) can be used, said conventional product having a structure including cylinders 40 and piston rods 41 which is pushed up and down slowly from the cylinders 40 so as to slowly drive the piston rods 41 relative to the fixed cylinders 40; or slowly drive the cylinders 40 relative to the fixed piston rods 41. In this embodiment, as shown in FIG. 2, the sliders 2A are placed relative to the cylinders 40 by pushing end portions of the cylinders into the holding portion 27 from a radial direction; holding the end portions thereof; and engaging corresponding portions of the cylinders with the clamp portions 28*a*, 28*b* on both sides. On the other hand, the sliders 2B are placed relative to the piston rods 41 by inserting end portions of the piston rods 41 into the holding bore 37 from one end side; and locking the screws S into the end portions of the piston rods 41 through the attachment bore 38 from the other end side of the holding bore 37.

Next, the above-mentioned sliders 2A, 2B with the latches 5; the braking means 4; and the urging means 3 are prepared as a pair. The above-mentioned pair are placed in the case 1 and covered by the cover 15. Here, for example, as shown in FIGS. 5(*a*), 5(*b*), the slider 2A and the slider 2B are fitted into the corresponding projections 22 or 32 relative to the guide grooves 12*b* of the case 1. Each latch 5 is fitted into the corresponding convex 52 relative to the guide grooves 14 of the case 1. From that state, the coil spring which is the urging means 3 is placed between the sliders 2A, 2B. Specifically, one end of the coil spring is locked into the locking axis 25 of the slider 2A, and the other end of the coil spring is locked into the locking axis 35 of the slider 2B, so that the coil spring can urge both sliders 2A, 2B in a direction wherein they move closer to each other.

From the above-mentioned state, preferably, as shown in FIGS. 5(*a*), 5(*b*), the slider 2A and the slider 2B are moved such that they are separated from each other up to the maximum distance L against an urging force of the urging means 3. The convex 52 of the latch 5 of the slider 2A is engaged with one of the locking grooves 14*b*. The convex 52 of the latch 5 of the slider 2B is engaged with the other side of the locking grooves 14*b*. In this process, as shown in FIGS. 6(*a*), 6(*b*), and 5(*a*), 5(*b*), the latch 5 of the slider 2A and the latch 5 of the slider 2B are rotated around the shafts 8 as a fulcrum from a position wherein the hook portions 50 are moved closer to the relevant slider sides (position for engaging the engagement pins 9, hereinafter called a pull-in position) to a position wherein the hook portions 50 are moved away from the slider sides (position for releasing the engagement of the engagement pins 9, hereinafter called a non-pull-in position) In the pull-in position, the position is maintained in a state wherein the latches 5 fit the supporting portions 54 into the groove 23 of the slider 2A, or into the groove 33 of the slider 2B. At last, the cover 15 is attached to the case 1. In this operation, after the cover 15 is placed in the space portions 10 on the case side, the multiple screws S are screwed into the attachment bore 16*a* on the cover side from the attachment bore 12*a* on the case side.

(Operation) In the above-mentioned assembled state, in the pull-in unit 6 which becomes a major portion of the manufactured sliding assistance mechanism, each slider 2A, 2B, each latch 5, the braking means 4; and the urging means 3 are sandwiched between the upper faces 12 of the case and the lower face 16 of the cover. Each slider 2A, 2B is fitted into the upper and lower guide grooves 12*b*, 16*b* corresponding to the upper and lower projections 22, 32, and slid while maintaining the fitted state thereof. Each latch 5 is fitted into the upper and lower guide grooves 14, 19 corresponding to the upper and lower convexes 52, and when each convex 52 is fitted into the linear grooves 14*a*, 19*a*, the latch 5 becomes the above-mentioned pull-in position, and when each convex 52 is engaged with the locking grooves 14*b*, 19*b*, the latch 5 is switched to the above-mentioned non-pull-in position.

Next, specific operations will be explained with reference to FIGS. 10(*a*), 4(*a*) to 6(*b*). Incidentally, FIGS. 4(*a*) to 4(*c*)

show schematically the case wherein the above-mentioned sliding assistance mechanism (pull-in unit 6) is applied to the double sliding doors in FIG. 10(*a*), and the reference numeral 70 represents guide rails on the upper side of a sliding door frame provided in the opening portion of the main body 7. FIG. 4(*a*) shows a state wherein the sliding doors A, B are half-open, and a schematic relationship between the pull-in unit 6 attached to the guide rails 70 and each engagement pin 9 provided in the sliding doors A, B.

(1) In FIGS. 4(*a*) to 4(*c*), when the opening portion is fully-opened by switching the sliding doors A, B to the open position, the sliding door A is slid to the right, i.e., in an open direction from the opened (half-opened) position in FIG. 4(*a*), and the sliding door B is slid to the left, i.e., in the open direction from the opened (half-opened) position in F*ig*. 4(*a*). Then, when the sliding door A is slid until just before (halfway) the closed position, as shown in F*ig*. 5(*b*), the engagement pin 9 on the left contacts inside of the hook portion 50 of the latch 5 of the slider 2A. The latch 5 is rotated counterclockwise around the shafts 8 as the fulcrum due to stress, and each convex 52 is released from the engagement of the locking grooves 14*b*, 19*b*, so that the convex 52 is fitted into the linear grooves 14*a*, 19*a*. Accordingly, as shown in F*ig*. 6(*a*), the engagement pin 9 is switched to the pull-in position held by the hook portion 50. Then, the slider 2A comes to the closed position by being pulled into a slider 2B side due to an urging force of the urging means 3 with the latch 5. in this case, in the slider 2A, the upper and lower projections 22, are guided along the upper and lower guide grooves 12*b*, 16*b*, and in the latch 5, the upper and lower convexes 52 are guided along the upper and lower linear grooves 14*a*, 19*a*. Incidentally, the sliding door B is also switched to the closed position in the same way as the sliding door A. Also, in this embodiment, when the sliding doors A, B are slid due to an urging force of the urging means 3, they are slowly slid due to the braking of the braking means 4.

(2) In FIGS. 4(*a*) to 4(*c*), in the case wherein the sliding doors A, B are switched to the closed position and the opening portion is fully closed, the sliding door A is slid from the opened (half-opened) position as shown in F*ig*. 4(*a*), or to the left, i.e., the closed direction from the open position as shown in F*ig*. 4(*b*). The sliding door B is slid from the opened (half-opened) position as shown in F*ig*. 4(*a*), or to the right, i.e., the closed direction from the open position as shown in F*ig*. 4(*b*). Then, when the sliding door A is slid until just before (halfway) the closed position, as shown in FIG. 5(*b*), the engagement pin 9 on the right contacts inside of the hook portion 50 of the latch 5 of the slider 2B. The latch 5 is rotated clockwise around the shafts 8 as the fulcrun due to stress, and each convex 52 is released from the holding of the locking grooves 14*b*, 19*b*, so that the convex 52 is fitted into the linear grooves 14*a*, 19*a*. Accordingly, as shown in F*ig*. 6(*b*), the engagement pin 9 is switched to the pull-in position held by the hook portion 50. Then, the slider 2B comes to the open position by being pulled into a slider 2A side due to an urging force of the urging means 3 with the latch 5. In this case, in the slider 2B, the upper and lower projections 32 are guided along the upper and lower guide grooves 12*b*, 16*b*, and in the latch 5, the upper and lower convexes 52 are guided along the upper and lower linear grooves 14*a*, 19*a*, Incidentally, the sliding door 13 is also switched to the open position in the same way as the sliding door A. Also, in this embodiment, when the sliding doors A, B are slid due to an urging force of the urging means 3, they are slowly slid due to the braking of the braking means 4.

Figure 12:
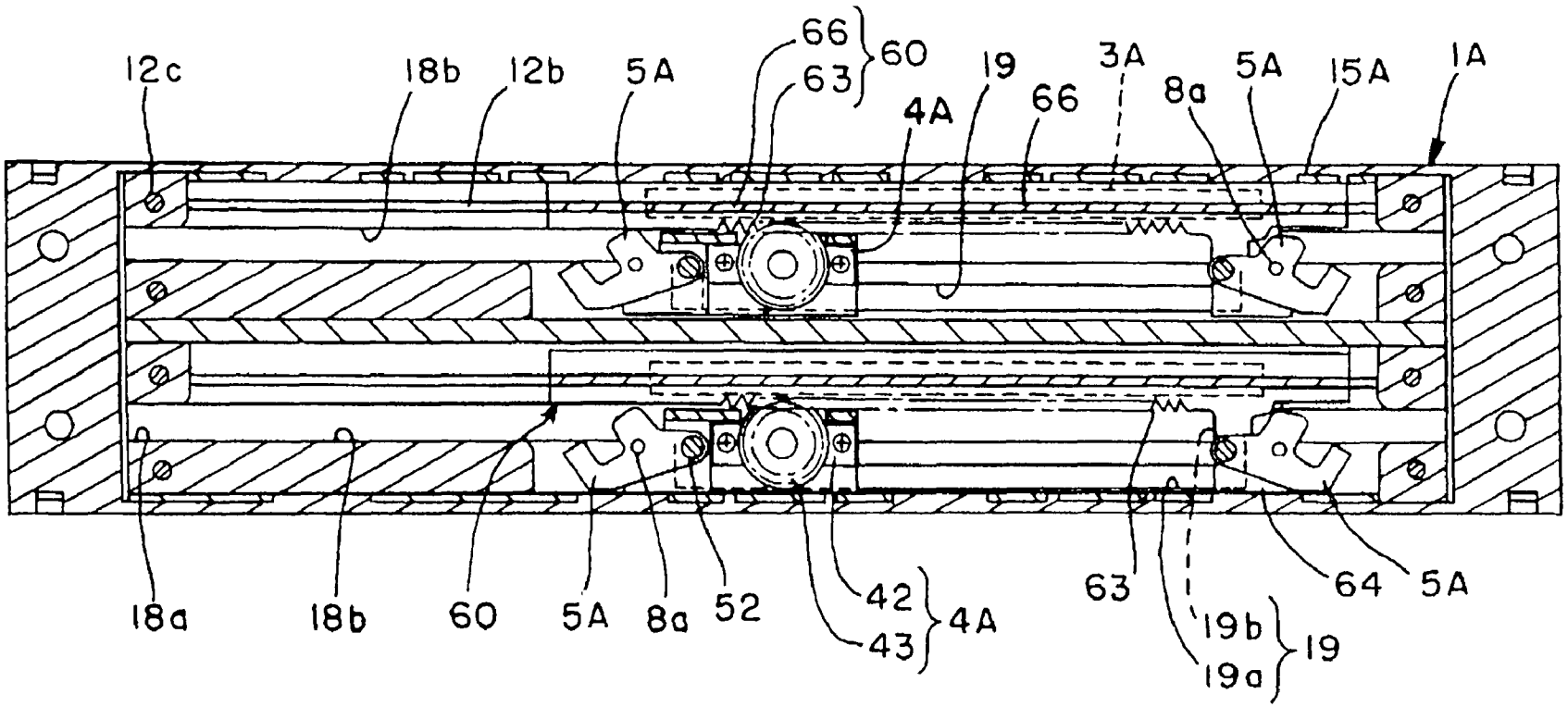
FIG. 12 is an enlarged sectional view taken along line E-E in FIG. 1(*b*).
Figure 13:
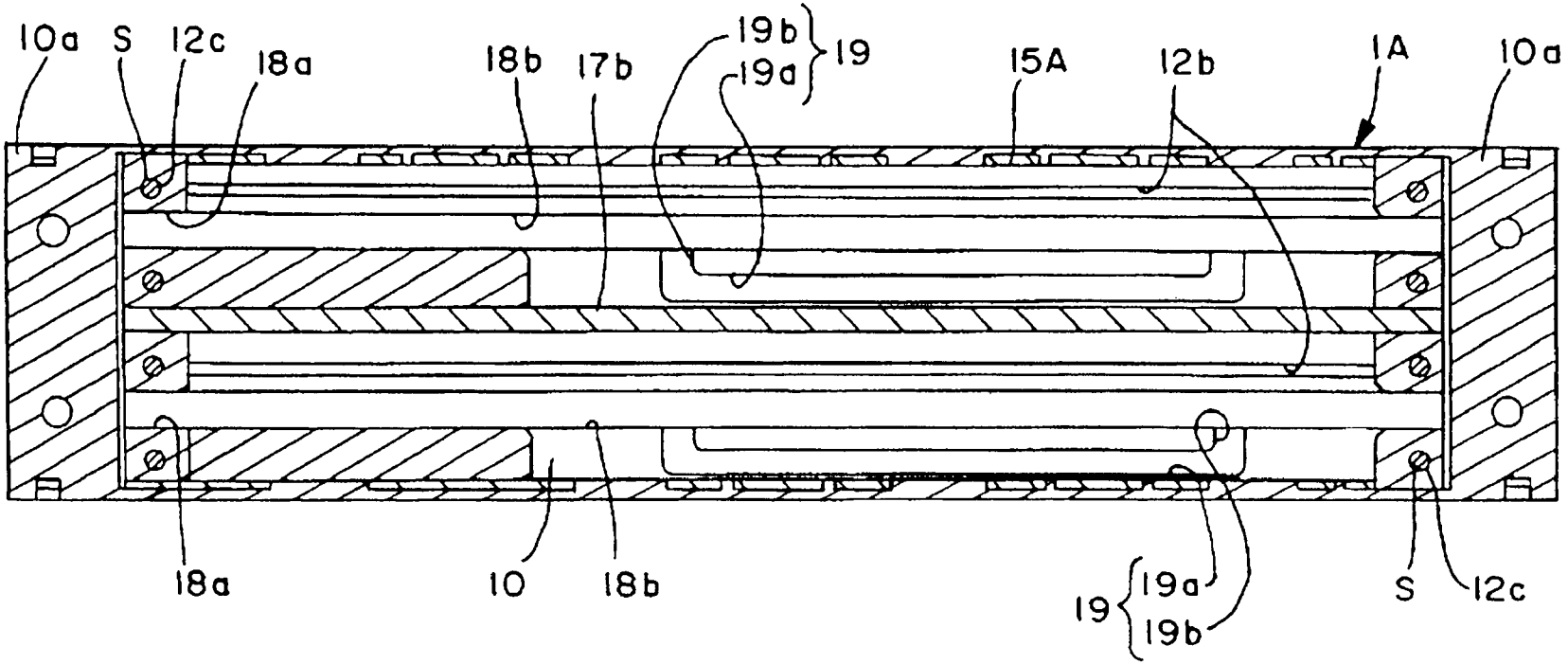
FIG. 13 is a pattern diagram showing a shape of the case wherein each member is omitted from FIG. 13.
Figure 14A:
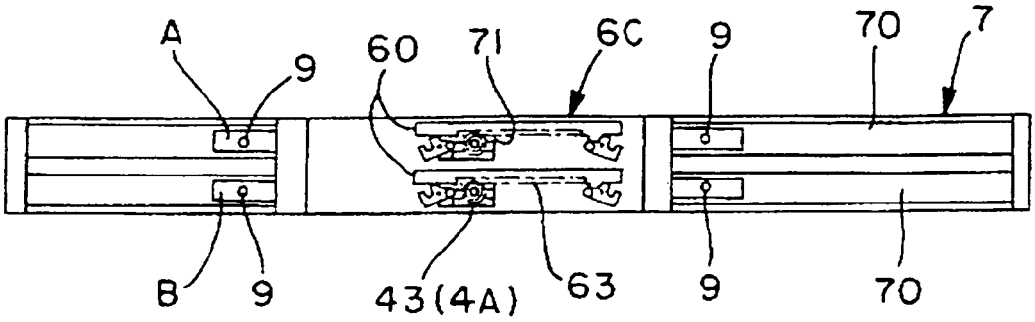
FIG. 14(*a*) to FIG. 14(*c*) are pattern diagrams showing relationships between the pull-in unit and the frame on the main body side wherein the double sliding doors are placed in the second embodiment, corresponding to FIG. 4.
Figure 14B:
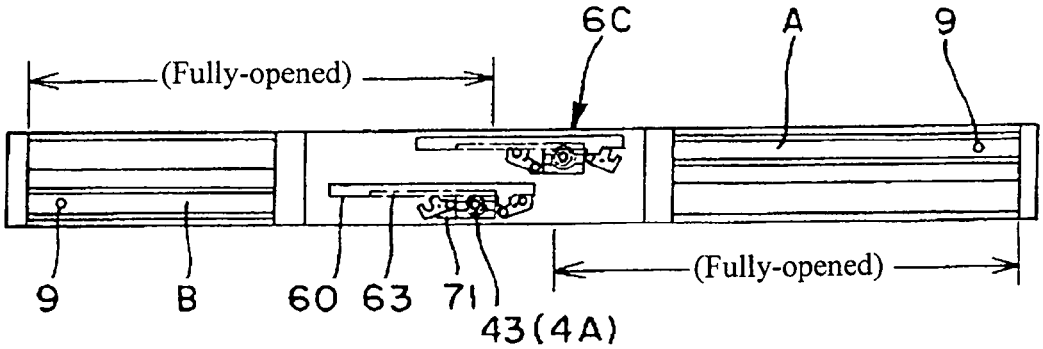
Figure 14C:
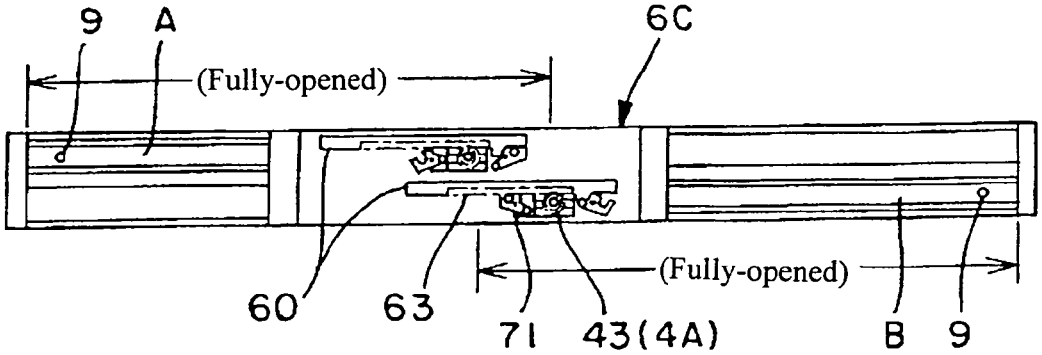
Figure 15A:
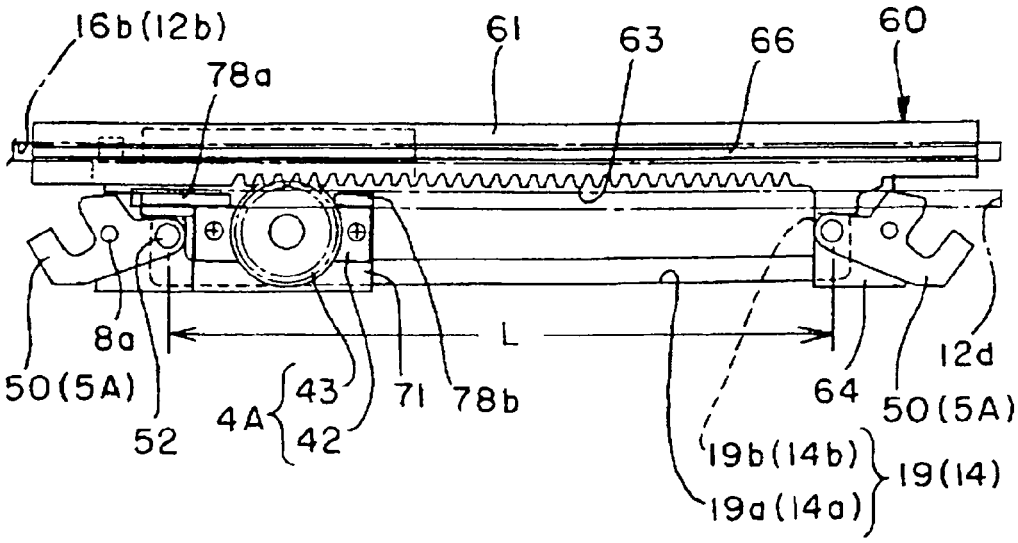
FIG. 15(*a*), FIG. 15(*b*) are pattern diagrams showing the states wherein the essential parts of the pull-in unit in a state of FIG. 14(*a*) are viewed from the top and the bottom.
Figure 15B:
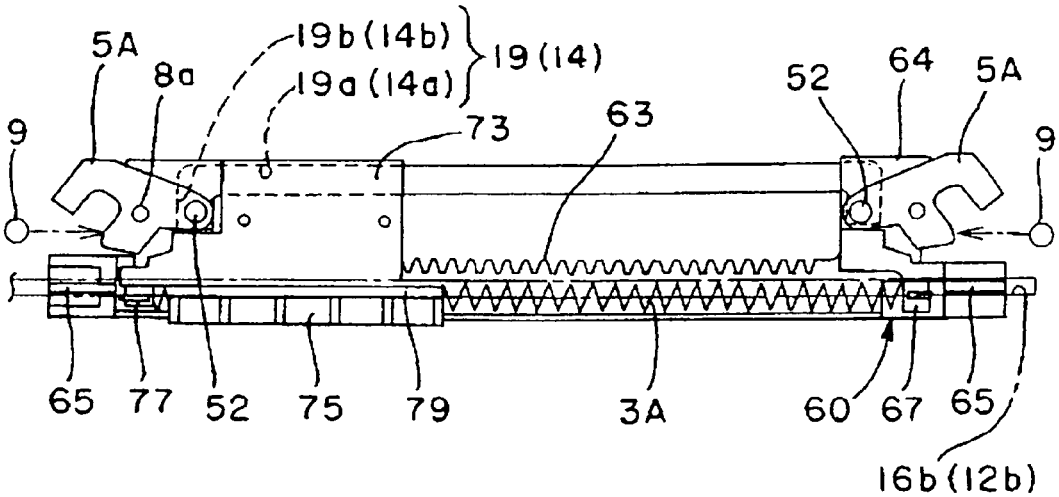

(Pull-In Unit of the Second Embodiment) FIGS. 11(*a*) to 11(*d*) show the pull-in unit; FIGS. 12, 13 show an internal structure of the pull-in unit; FIGS. 14(*a*) to 14(*c*) show embodiments; FIGS. 15(*a*), 15(*b*), 16(*a*), 16(*b*) show the operations of the essential parts; and FIGS. 17(*a*) to 19(*e*) show main component members of the pull-in unit. The pull-in unit 6C of the second embodiment includes the racks 60 placed in the case 1A; the slider 71 including the rotary gear 45 engaging the racks 60; the urging means 3A urging in a direction wherein the racks 60 and the slider 71 move relatively closer to each other through the rotary gear 45; and the pair of latches 5A, 5A pivotally supported at the racks 60 and the slider 71 respectively, and releasably locked to corresponding parts of the case 1A so that the racks 60 and the slider 71 can be held in a predetermined position.

As for the above-mentioned portions, since the case 1A is similar to the case 1 of the first embodiment, a drawing for the single portion is omitted, and also the same reference numerals are used for the same operational members and parts. Specifically, as shown in FIGS. 11(*a*) to 13, the case 1A integrally forms the space portions 10 which open the lower side; and the attachment portions 10*a* for the main body which project to right and left of the space portions 10. The case 1A also includes a cover 15A attached to close the space portions 10. The space portions 10 have the shape of the elongated short container, and divided into the upper face 11, both side faces 12, and right and left end faces 13. The cover 15A has the form of the flat container with a size so that it can be roughly stored in the space portions 10. Inside of the cover 15A is divided into the lower face 16, both side faces 17, right and left end faces 18, and the dividing portion 17*b* which divides the inside of the cover 15A into two.

Also, on both side faces 12 and both side faces 17, the multiple pairs of projecting locking portions 12*a* and the bore-like engagement portions 17*a* are provided and engage to each other when the cover 15A is placed in the space portions 10. In each end face 13 and each end face 18, when the cover 15A is placed on the space portions 10, the openings 13*a*, 18*a* with the concave or reverse-concave shape are bilaterally provided in 2 places on each side, and the inside and outside of the openings 13*a*, 18*a* are respectively communicated to each other so that the engagement pins 9 can penetrate. Also, on the lower face 16 of the cover, the guiding bores 18*b* are formed in such a way as to communicate with the respective right and left openings 18*a*, 18*a*. Thus, the engagement pins 9 can go in and out of the case 1A along the guiding bores 18*b* through the openings 13*a* of the end faces 13 and the openings 18*a* of the end faces 18 relative to the case 1.

On the upper face 12 and the lower face 16, the attachment bores 12*c*, 16*a;* the opposed guide grooves 12*b*, 16*b* (refer to FIGS. 15 (*a*), 15(*b*)); and the guide grooves 14, 19 for the latches are provided roughly facing each other. In addition, as schematically shown in FIGS. 15(*a*), 15(*b*), on the upper face 12, a guide groove 12*d* which is shorter than the guide groove 12*b* is provided in parallel with the guide groove 12*b*. As for the above-mentioned portions, the screws S are screwed into the attachment bores 12*c*, 16*a* when the cover 15A is attached to the space portions 10. The respective guide grooves 12*b*, 16*b* have the respective pairs of linear grooves, and guide the racks 60 to slide in a state wherein each guide groove 12*b*, 16*b* is fitted into projections 66 or 65 provided on upper and lower faces of the racks 60. Each guide groove 14, 19 includes the pair of linear grooves 14*a*, 19*a* which are respectively parallel to the guide grooves 12*b*, 16*b*, and the guide groove 12*d;* and the locking grooves 14*b*, 19*b* with a roughly L shape provided on both sides of the linear grooves 14*a*, 19*a*. Each guide groove 14, 19 includes the convexes 52 wherein the latches 5A are provided on the upper and lower faces described hereinafter, and guides the latches 5A to slide along the linear grooves 14*a*, 19*a* in the state of fitting into the convexes 52. Also, the convexes 52 lock the sliding of the latches 5A by engaging the locking grooves 14*b*, 19*b*.

Figure 16A:
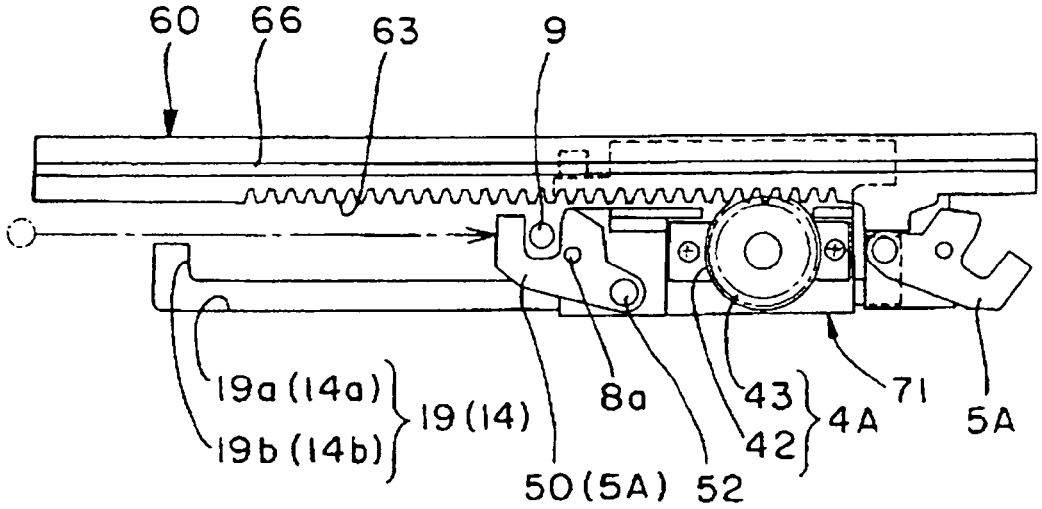
FIG. 16(*a*), FIG. 16(*b*) are pattern diagrams showing the essential parts of the pull-in unit in states of FIG. 14(*b*), FIG. 14(*c*).
Figure 16B:
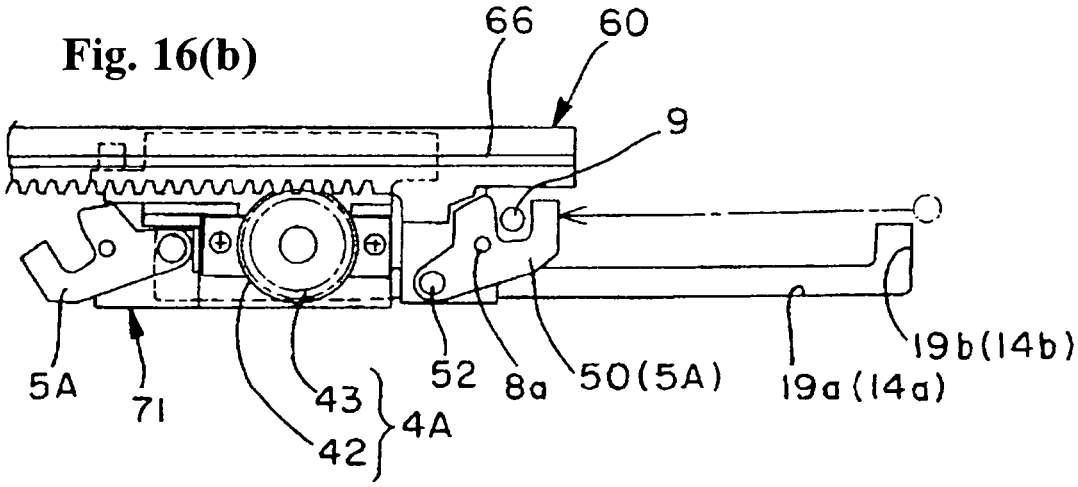
Figure 17A:
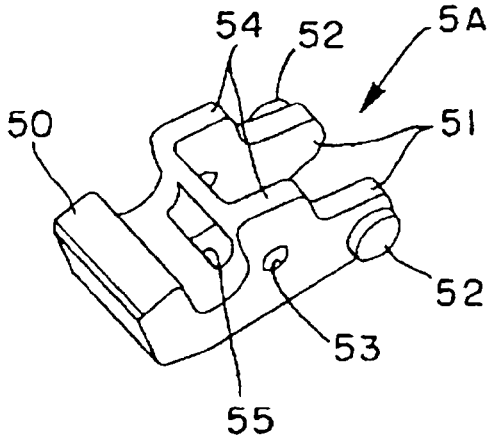
FIG. 17(*a*) is an external view showing the latch of the pull-in unit of the second embodiment.
Figure 17B:
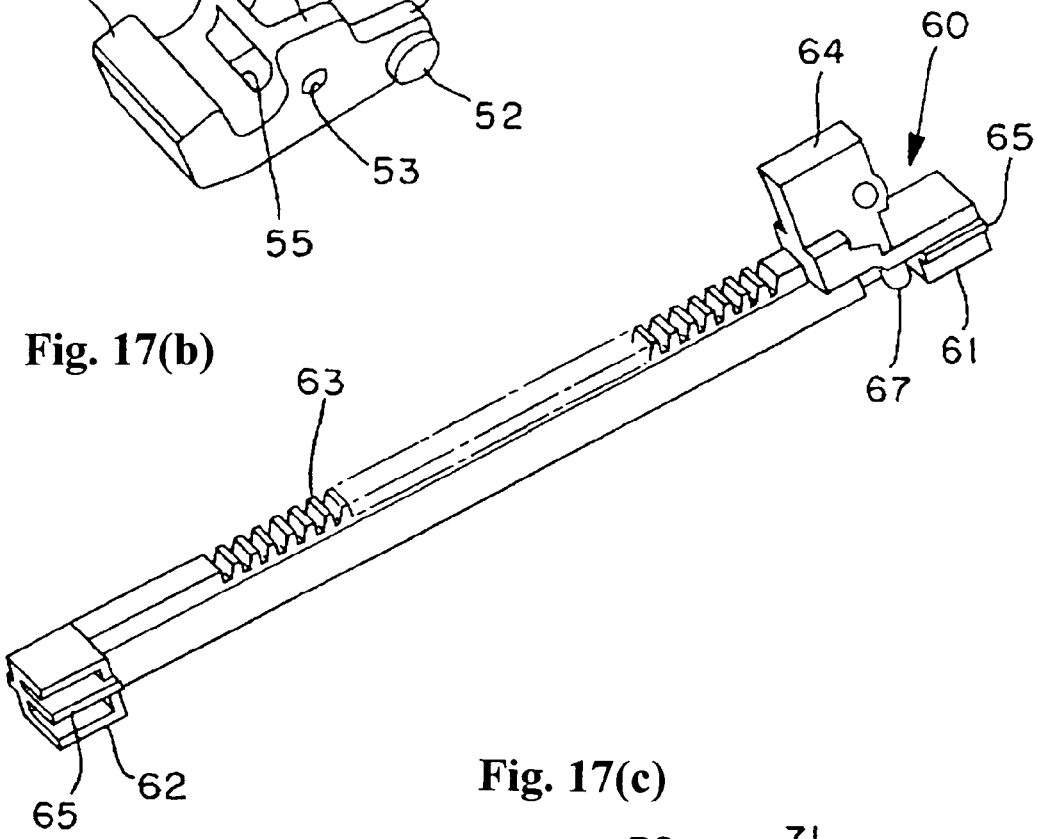
Figure 17C:
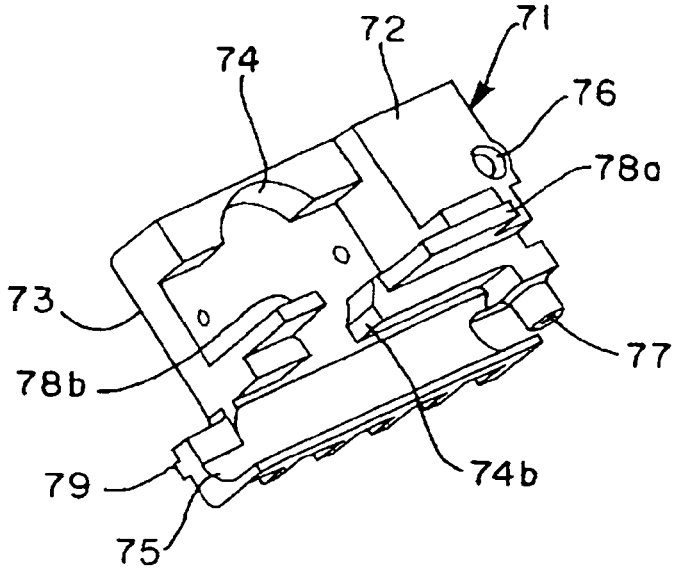

Since the latches 5A are also roughly the same as the first embodiment, the same reference numerals as the first embodiment are used. Specifically, as shown in FIG. 17(*a*), the latches 5A integrally include the hook portions 50 with a roughly U shape; the pair of arm portions 51 projecting from both sides of the base portion of the hook portions 50; the axial bores 53 respectively provided on the coaxial line in roughly the middle part of each arm portion 51; the convexes 52 respectively projecting from the outer surface of the end of each arm portion 51; the supporting portions 54 provided near the axial bore 53 of each arm portion 51 and projecting to the same direction as that of the hook portions 50; and a window portion 55 provided on the wall surface on the supporting portions 54 of the hook portions 50. As for the above-mentioned portions, as shown in FIGS. 16(*a*), 6(*b*), the hook portions 50 have a shape to be able to hold the engagement pins 9 in a state where the latches 5A are rotated around shafts 8*a* as a fulcrum.

Figures 18A, 18B, 18C:
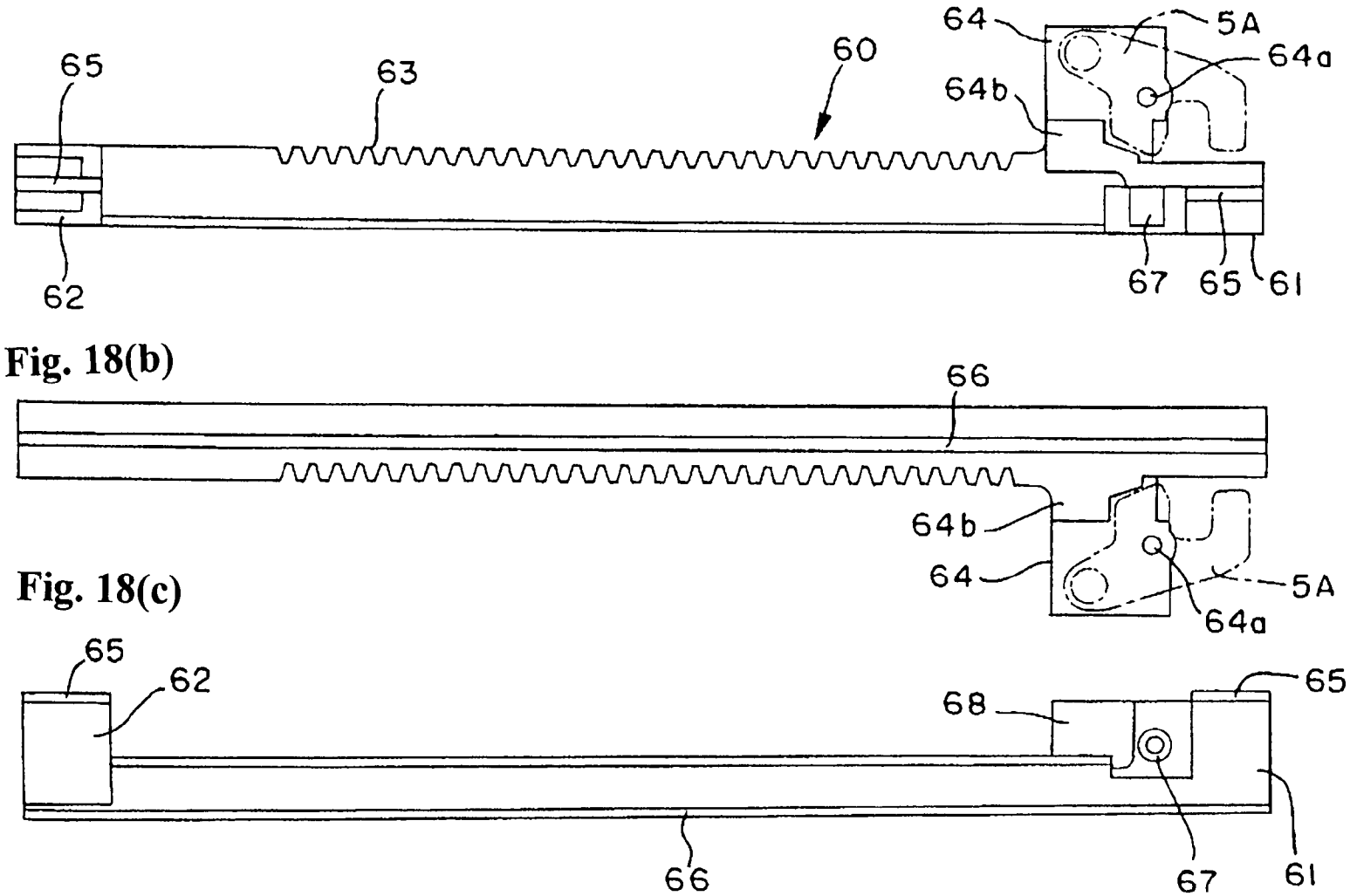
FIG. 18(*a*), FIG. 18(*b*), FIG. 18(*c*) show details of the rack, wherein FIG. 18(*a*) is a bottom view.

As shown in FIGS. 2, 17(*a*) to 17(*c*), 18(*a*) to 18(*c*), each rack 60 has an elongated arm-like shape providing a space between the upper face 12 of the above-mentioned case side and the lower face 16 of the cover side. The rack 60 includes the projections 65, 65, wherein both ends 61, 62 are projected downward, provided on these projected end faces and fitted into the guide grooves 16*a* on the cover side; a supporting plate portion 64 projecting from the side face near one end 61; a tooth portion 63 with a waveform formed along one side face between the supporting plate portion 64 and the other end 62 and located slightly before the other end 62; and a locking axis 67 for a spring which projects in an opposite direction to the supporting plate portion 64 on the side face near one end 61. Here, the supporting plate portion 64 is configured on the plate thickness which is inserted between both arm portions 51 on the above-mentioned latch side. The supporting plate portion 64 forms an axial bore 64*a* penetrating up and down, and respectively forms control wall portions 64*b* for the latches on upper and lower faces. As shown by imaginary lines in FIGS. 18(*a*), 18(*b*), the latch 5A is placed in the supporting plate portion 64, and the shaft 8*a* penetrates into one of the axial bores 53, the axial bore 64*a*, and the other side of the axial bores 53, so that the latch 5A can be rotated. In this case, as shown in FIGS. 15(*a*), 15(*b*), the latch 5A is pushed by the engagement pin 9 and rotates around the shaft 8*a* as a fulcrum. Accordingly, the latch 5A is switched to a holding state wherein the opening of the hook portion 50 approaches the corresponding portion of the rack 60 from a non-holding state wherein the hook portion 50 does not hold the engagement pin 9. The corresponding portion of the hook portion 50 abuts against the control wall portions 64*b*, so that the latch 5A can maintain the holding state.

As shown in FIGS. 2, 17(*a*) to 17(*c*), 19(*a*) to 19(*e*), the slider 71 has a block shape placed in a space between the upper face 12 on the case side and the lower face 16 on the cover side. The slider 71 integrally includes a damper engagement concave 74 and projections 78*a*, 78*b* provided on an upper face 72; a spring support portion 75 and a spring locking axis 77 provided along one side; and a projection 79 and a latch placement portion 73*a* provided on the lower face 73. Here, the latch placement portion 73*a* is provided in such a way that one end side corner portion of the lower face 73 has one step lower than the lower face 73. The reference numeral 73*b* is a latch control wall portion. The engagement concave 74 has a shape corresponding to a rotary damper 4A, and forms a pair of attachment bores 74*a* which penetrate to the bottom face; and an opening portion 46*b* which forms an opening on one side. The projections 78*a*, 78*b* fit into the above-mentioned guide groove 12*d* to be freely slidable. The spring support portion 75 is formed in roughly a C shape in a cross sectional view in order to be able to hold a coil-shaped spring. The projection 79 can fit into the guide groove 16*b* on the cover side to be freely slidable.

For the above-mentioned slider 71, the latch 5A and the rotary damper 4A are assembled. As for the above-mentioned portions, as shown by imaginary lines in FIGS. 19(*a*), 19(*b*), the latch 5A is placed in the corresponding part of the slider 71, and the shaft 8*a* penetrates into one of the axial bores 53, an axial bore 76, and the other side of the axial bores 53, so that the latch 5A is assembled to be rotatable. As shown in FIGS. 15(*a*), 15(*b*), the latch 5A is pushed by the engagement pin 9 and rotates around the shaft 8*a* as the fulcrum. Accordingly, the latch 5A is switched to the holding state (shown by the imaginary lines in FIGS. 19(*a*), 19(*b*)) wherein the opening of the hook portion 50 approaches to an extended line of the spring support portion 75 of the rack 60 from the non-holding state wherein the hook portion 50 does not hold the engagement pin 9. The corresponding portion of the hook portion 50 abuts against the control wall portion 73*b*, so that the latch 5A can maintain the holding state.

The rotary damper 4A is attached by screws in a state of being positioned in the engagement concave 74. The damper 4A comprises a well-known rotary oil damper and the like, and includes a main body 42 and a rotary gear 43 placed in an output axis (not shown) receiving resistance of hydraulic oil inside the main body. Incidentally, the rotary damper 4A may be an air damper.

(Assembly) The above-mentioned members are assembled to form the pull-in unit 6C by, for example, as mentioned above, pivotally attaching each latch 5A to the racks 60 and the slider 71; placing the rotary damper which is the braking means 4A in the slider 71; making two pairs of the above, and then, assembling those pairs with each urging means 3A to the case 1A.

Specifically, as a set of the racks 60 wherein the latches 5A are attached; the slider 71 wherein the braking means 4 and the latches 5A are attached; and the urging means 3, two sets thereof are placed in the case 1A and covered by the cover 15A. Here, for example, as shown in FIGS. 15(*a*), 15(*b*), the projections 66 of the racks 60 are fitted into the guide grooves 12*b* of the case 1A; the projections 78*a*, 78*b* of the slider 71 are fitted into the guide groove 12*d* of the case 1A; each latch 5A is fitted into the corresponding convex 52 relative to the guide grooves of the case 1A; and further, the rotary gear 43 is engaged with tooth portions 65 of the rack. In the above-mentioned state, the coil springs which are the urging means 3A are placed between the racks 60 and the slider 71. Specifically, one end of the coil spring is locked in the locking axis 77 of the slider 71 and the other end of the coil spring is locked in the locking axis 67 of the rack 60, so that the coil spring can urge the latches 5A, 5A in such a direction as to approach each other.

In the above-mentioned state, preferably, as shown in FIGS. 15(*a*), 15(*b*), the rack 60 and the slider 71 are relatively moved against the urging force of the urging means 3 so that the latches 5A, 5A are separated from each other up to the maximum distance L. Accordingly, the convex 52 of the latch 5A of the rack side is engaged with one of the locking grooves 14*b* and the convex 52 of the latch 5A of the slider side is engaged with the other of the locking grooves 14*b*. In this process, as shown in FIGS. 16(*a*), 16(*b*), 15(*a*), 15(*b*), the latch 5A on the rack side and the latch 5A on the slider side are rotated around the shafts 8 as the fulcrum from the position wherein the hook portions 50 approach a tooth portion 63 side (position of engaging the engagement pins 6, hereinafter called the pull-in position) to the position wherein the hook portions 50 are moved away from the tooth portion 63 side (position releasing the engagement of the engagement pins 9, hereinafter called the non-pull-in position). At last, the cover 15A is attached to the case 1A. In this operation, after the cover 15A is placed in the space portions 10 on the cover side, the multiple screws S are screwed into the attachment bores 12*c* on the case side from the attachment bores 16*a* on the cover side.

(Operation) As for the above-mentioned assembled state, in the pull-in unit 6C which becomes the main component of the manufactured sliding assistance mechanism, the racks 60 and the braking means 4A; the latches 5A and the slider 71; and the latches 5A and the urging means 3A are sandwiched between the upper face 12 on the case side and the lower face 16 on the cover side. In the racks 60, the upper and lower projections 66, 65 are fitted into the corresponding upper and lower guide grooves 12*b*, 16*b*, and the racks 60 are slid while maintaining the above-mentioned fitted state. In the slider 71, the projections 78*a*, 78*b* on the upper side are fitted into the corresponding guide groove 12*d*, and the projection 79 on the lower side is fitted into the corresponding guide groove 16*b*. The slider 71 is slid while maintaining the above-mentioned fitted state. In each latch 5A, the upper and lower convexes 52 are fitted into the corresponding upper and lower guide grooves 14, 19. When each convex 52 is fitted into the linear grooves 14*a*, 19*a*, the latch 5A becomes the above-mentioned pull-in position, and when the convex 52 engages the locking grooves 14*b*, 19*b*, the latch 5A is switched to the above-mentioned non-pull-in position. Incidentally, in FIGS. 16(*a*), 16(*b*), in order to avoid complication, each guide groove is omitted.

Next, concrete operations will be explained with reference to FIGS. 10(*a*), 14(*a*) to 16(*b*). Incidentally, FIGS. 14(*a*) to 14(*c*) schematically show the case wherein the sliding assistance mechanism (pull-in unit 6C) is applied to the double sliding doors in FIG. 10(*a*), and the reference numeral 70 visualizes the guide rails on the upper side of the sliding door frame provided in the opening portion of the main body 7. FIG. 14(*a*) shows the state wherein the sliding doors A, B are half-open, and the schematic relationship between the pull-in unit 6C attached to the guide rails 70 and each engagement pin 9 provided in the sliding doors A, B.

In FIGS. 14(*a*) to 14(*c*), when the opening portion is fully-opened by switching the sliding doors A, B to the open position, the sliding door A is slid to the right, i.e., in the open direction from the opened (half-opened) direction as shown in FIG. 14(*a*), and the sliding door B is slid to the left, i.e., in the open direction from the opened (half-opened) position, as shown in FIG. 14(*a*). Then, when the sliding door A is slid until just before (halfway) the open position, as shown in F*ig*. 15(*b*), the engagement pin 9 on the left contacts inside of the hook portion 50 of the latch 5A of the slider side. The latch SA is rotated counterclockwise around the shafts 8 as the fulcrum due to stress, and each convex 52 is released from the engagement of the locking grooves 14*b*, 19*b*, so that the convex 52 is fitted into the linear grooves 14*a*, 19*a*. Accordingly, as shown in F*ig*. 16(*a*), the engagement pin 9 is switched to the pull-in position held by the hook portion 50. Then, the slider 71 comes to the closed position by being pulled into the latch SA on the rack side due to an urging force of the urging means 3A with the latch 5A. In this case, in the slider 71, the above-mentioned projections 78*a*, 78*b*and the projection 79 are guided along the upper and lower guide grooves 12*d*, 16*b*, and in the latch 5A, the upper and lower convexes 52 are guided along the upper and lower linear grooves 14*a*, 19*a*. The sliding door B is also switched to the closed position in the same way as the sliding door A. Also, in this embodiment, when the sliding doors A, B are slid due to an urging force of the urging means 3, since the rotary gear 43 which is the braking means 4A is engaged with the tooth portion 63 on the rack, the sliding doors A, B are slowly slid due to the braking of the braking means 4.

In FIGS. 14(*a*) to 14(*c*), in the case wherein the sliding doors A, B are switched to the closed position and the opening portion is fully closed, the sliding door A is slid from the opened (half-opened) position as shown in F*ig*. 14(*a*), or to the left, i.e., the closed direction from the open position shown in F*ig*. 14(*b*). The sliding door B is slid from the opened (half-opened) position as shown in FIG. 14(*a*), or to the right i.e., the closed direction from the open position as shown in FIG. 14(*b*). Then, when the sliding door A is slid until just before (halfway) the closed position, as shown in FIG. 15(*b*), the engagement pin 9 on the right contacts inside of the hook portion 50 of the latch 5A on the rack side. The latch 5A is rotated clockwise around the shafts 8*a* as the fulcrum du to stress, and each convex 52 is released from the engagement of the locking grooves 14*b*, 19*b*, so that the convex 52 is fitted into the linear grooves 14*a*, 19*a*. Accordingly, as shown in FIG. 16(*b*), the engagement pin 9 is switched to the pull-in position held by the hook portion 50. Then, the rack 60 comes to the open position by being pulled into a latch 5A side of the slider 71 due to an urging force of the urging means 3A with the latch 5A. In this case, in the rack 60, the upper and lower projections 66, 65 are guided along the upper and lower guide grooves 12*b*, 16*b*, and in the latch 5A, the upper and lower convexes 52 are guided along the upper and lower linear grooves 14*a*, 19*a*. Incidentally, the sliding door B is also switched to the open position in the same way as the sliding door A. Also, in this embodiment, when the sliding doors A, B are slid due to an urging force of the urging means 3A, they are slowly slid due to the braking of the braking means 4A. This function is the same as that in the first embodiment; however, since their sliding is braked through the engagement between the tooth portions 65 on the rack side and the rotary gear 43 on the braking means side, a further stable braking force can he provided.

Incidentally, the sliding assistance mechanism and the pull-in unit of the present invention can be modified except for requirements specified in claims. Also, the sliding assistance mechanism and the pull-in unit of the present invention do not have any special restriction for applications, for example, if the moving body is a drawer body or a tray, the pushed-in position has a meaning same as the closed position of the above-mentioned embodiments, and the pushed-out position has a meaning same as the open position of the embodiments.

The disclosure of Japanese Patent Applications No. 2006-306183 filed on Nov. 13, 2006 and No. 2007-076620 filed on Mar. 23, 2007, are incorporated in the application.

What is claimed is:

1. A sliding assistance mechanism for helping a switching operation of a moving body from a first position to a second position, or from the second position to the first position of a main body, through a halfway position, comprising:

a case attached to said main body;

a first moving member and a second moving member slidably provided on the case, respectively;

a pair of latches, each being pivotally supported at each moving member, respectively, and releasably locked to a corresponding part of said case;

an urging device provided between the moving members for urging the moving members to move closer to each other;

a guide groove provided in the case for moving the latches along the same; and first and second operational members spaced apart from each other and provided in the moving body, wherein when said moving body is moved to the halfway position from the first position to the second position, an engagement of one of the latches with the second operational member provided in the second moving member is released, and when the first operational member is engaged with the other of the latches, the moving body is pulled by the urging device to the second position.

2. A sliding assistance mechanism according to claim 1, wherein said first and second moving members comprise a pair of sliders moving close to and away from each other.

3. A sliding assistance mechanism according to claim 1, wherein said first and second moving members comprise a rack and a slider including a rotary gear engaging the rack.

4. A sliding assistance mechanism according to claim 3, wherein said rotary gear comprises a braking rotary damper.

5. A sliding assistance mechanism according to claim 1, further comprising a braking device for braking a sliding of each of the moving members.

6. A sliding assistance mechanism according to claim 5, wherein said braking device includes a piston-type damper or a rotary damper.

7. A sliding assistance mechanism according to claim 1, wherein a pull-in unit is provided with two sets of said first and second moving members, said urging device, said pair of latches and said guide groove in the case.

8. A sliding assistance mechanism according to claim 7, wherein said moving body comprises double sliding doors, and said pull-in unit is attached in at least one of an upper side of a frame and a lower side of the frame of said main body wherein the double sliding doors are provided.

9. A sliding assistance mechanism according to claim 1, wherein said moving body is a sliding door, and wherein said first position is a closed position of the sliding door and said second position is a fully open position of the sliding door.

10. A sliding assistance mechanism according to claim 1, wherein a pull-in unit is provided with said first and second moving members, said urging device, said pair of latches, and said guide groove in the case, and the pull-in unit helps the moving body to be switched from the first position to the second position or from the second position to the first position on a main body side.

11. A sliding assistance mechanism according to claim 1, wherein when said moving body is moved to the halfway position from the second position to the first position, the engagement of the other of the latches with the first operational member provided in the first moving member is released, and when the second operational member is engaged with the one of the latches, the moving body is pulled by the urging device to the first position.

12. A sliding assistance mechanism according to claim 11, wherein the guide groove includes a linear groove parallel to the urging device, and locking grooves provided on two sides of the linear groove to lock the moving members thereon.

13. A sliding assistance mechanism according to claim 12, wherein the first moving member is locked on the locking groove when the engagement of the one of the latches with the second operational member is released until the first operational member is engaged with the other of the latches, and the second moving member is locked on the locking groove when the engagement of the other of the latches with the first operational member is released until the second operational member is engaged with the one of the latches.

14. A sliding assistance mechanism according to claim 13, wherein each latch comprises an axial portion and a convex such that the latch rotates on the axial portion and the convex is moved by rotating the latch between the locking groove and the linear groove.

* * * * *